US012708138B2

(12) United States Patent
Fallon

(10) Patent No.: US 12,708,138 B2
(45) Date of Patent: Aug. 18, 2026

(54) ARTICLE FOR USE IN AN AEROSOL PROVISION SYSTEM

(71) Applicant: Nicoventures Trading Limited, London (GB)

(72) Inventor: Gary Fallon, London (GB)

(73) Assignee: Nicoventures Trading Limited, London (GB)

( * ) Notice: Subject to any disclaimer, the term of this patent is extended or adjusted under 35 U.S.C. 154(b) by 648 days.

(21) Appl. No.: 18/040,073

(22) PCT Filed: Aug. 2, 2021

(86) PCT No.: PCT/GB2021/051989
§ 371 (c)(1),
(2) Date: Jan. 31, 2023

(87) PCT Pub. No.: WO2022/023777
PCT Pub. Date: Feb. 3, 2022

(65) Prior Publication Data

US 2023/0270157 A1 Aug. 31, 2023

(30) Foreign Application Priority Data

Jul. 31, 2020 (GB) ..... 2011965

(51) Int. Cl.
*A24D 1/20* (2020.01)
*A24B 15/167* (2020.01)
(Continued)

(52) U.S. Cl.
CPC ..... *A24D 1/20* (2020.01); *A24B 15/167* (2016.11); *A24D 3/17* (2020.01); *A24F 40/465* (2020.01)

(58) Field of Classification Search
CPC ..... A24D 1/20; A24F 40/20
See application file for complete search history.

(56) References Cited

U.S. PATENT DOCUMENTS

2008/0092912 A1* 4/2008 Robinson ..... A24B 13/02 131/200
2011/0271968 A1* 11/2011 Carpenter ..... A24D 3/048 131/342

(Continued)

FOREIGN PATENT DOCUMENTS

JP 2017506915 A 3/2017
JP 2022527741 6/2022

(Continued)

OTHER PUBLICATIONS

International Search Report and Written Opinion received for PCT Patent Application No. PCT/GB2021/051989, mailed on Oct. 13, 2021, 13 pages.

(Continued)

*Primary Examiner* — Michael H. Wilson
*Assistant Examiner* — Stephanie Lynn Moore
(74) *Attorney, Agent, or Firm* — MERCHANT & GOULD P.C.

(57) ABSTRACT

An article for use with a non-combustible aerosol provision device having a mouth end and a distal end opposite the mouth end, the article including a first section including a first aerosol generating material, the first aerosol generating material including tobacco; and a second section including a second aerosol generating material, the second aerosol generating material including an aerosol former material; wherein the second section is relatively closer to the distal end than the first section.

31 Claims, 17 Drawing Sheets

(51) Int. Cl.
*A24D 3/17* (2020.01)
*A24F 40/465* (2020.01)

(56) References Cited

U.S. PATENT DOCUMENTS

| | | | | |
|---|---|---|---|---|
| 2018/0279681 | A1* | 10/2018 | Rojo-Calderon | A24D 1/002 |
| 2019/0116874 | A1* | 4/2019 | England | A24D 3/17 |
| 2019/0387787 | A1* | 12/2019 | Hejazi | A24F 40/465 |
| 2020/0029623 | A1* | 1/2020 | Rossoll | H05B 6/108 |

FOREIGN PATENT DOCUMENTS

| | | | |
|---|---|---|---|
| JP | 2022528776 | | 6/2022 |
| KR | 20170083598 | | 7/2017 |
| WO | 98/28994 | A1 | 7/1998 |
| WO | 2013/164124 | A1 | 11/2013 |
| WO | 2017/178394 | A1 | 10/2017 |
| WO | 2019073239 | A1 | 4/2019 |
| WO | 2019110747 | | 6/2019 |
| WO | 2019151687 | A1 | 8/2019 |
| WO | 2020/044181 | A1 | 3/2020 |
| WO | 2020127111 | | 6/2020 |

OTHER PUBLICATIONS

International Preliminary Report on Patentability received for PCT Patent Application No. PCT/GB2021/051989, mailed on Feb. 9, 2023, 8 pages.

JP Office Action received for Japanese Patent Application No. 2022-577609, mailed on Mar. 26, 2024 18 pages (9 pages of English Translation and 9 pages of Official Copy).

UA Office Action in Ukranian Application No. 2023-00050, dated Nov. 19, 2024, 15 pages.

Korean Office Action in Application No. 2023-7003463, dated Apr. 22, 2026, with Eng translation, 16 pages.

* cited by examiner

ARTICLE FOR USE IN AN AEROSOL PROVISION SYSTEM

PRIORITY CLAIM

The present application is a National Phase entry of PCT Application No. PCT/GB2021/051989, filed Aug. 2, 2021, which claims priority from GB Application No. 2011965.7, filed Jul. 31, 2020, each of which hereby fully incorporated herein by reference.

TECHNICAL FIELD

The present disclosure relates to an article for use in a non-combustible aerosol provision system and a non-combustible aerosol provision system including an article.

BACKGROUND

Certain tobacco industry products produce an aerosol during use, which is inhaled by a user. For example, tobacco heating devices heat an aerosol generating substrate such as tobacco to form an aerosol by heating, but not burning, the substrate.

SUMMARY

In some embodiments described herein, in a first aspect there is provided an article for use with a non-combustible aerosol provision device comprising a mouth end and a distal end: a first section comprising a first aerosol generating material, the first aerosol generating material comprising tobacco; and a second section comprising a second aerosol generating material, the second aerosol generating material comprising an aerosol former material; wherein the second section is relatively closer to the distal end than the first section.

In some embodiments described herein, in a second aspect there is provided a system comprising: a non-combustible aerosol provision device comprising a heater; and an article according to any one of the claims.

In some embodiments described herein, in a third aspect there is provided method of manufacturing an article for use with a non-combustible aerosol provision device comprising forming a first aerosol generating material; dividing the first aerosol generating material into sections of first aerosol generating material; forming a second aerosol generating material; dividing the second aerosol generating material into sections of second aerosol generating material; and combining said sections of first aerosol generating material with said sections second aerosol generating material.

BRIEF DESCRIPTION OF THE DRAWINGS

Embodiments of the disclosure will now be described, by way of example only, with reference to the accompanying drawings, in which.

DETAILED DESCRIPTION

Figure 1:
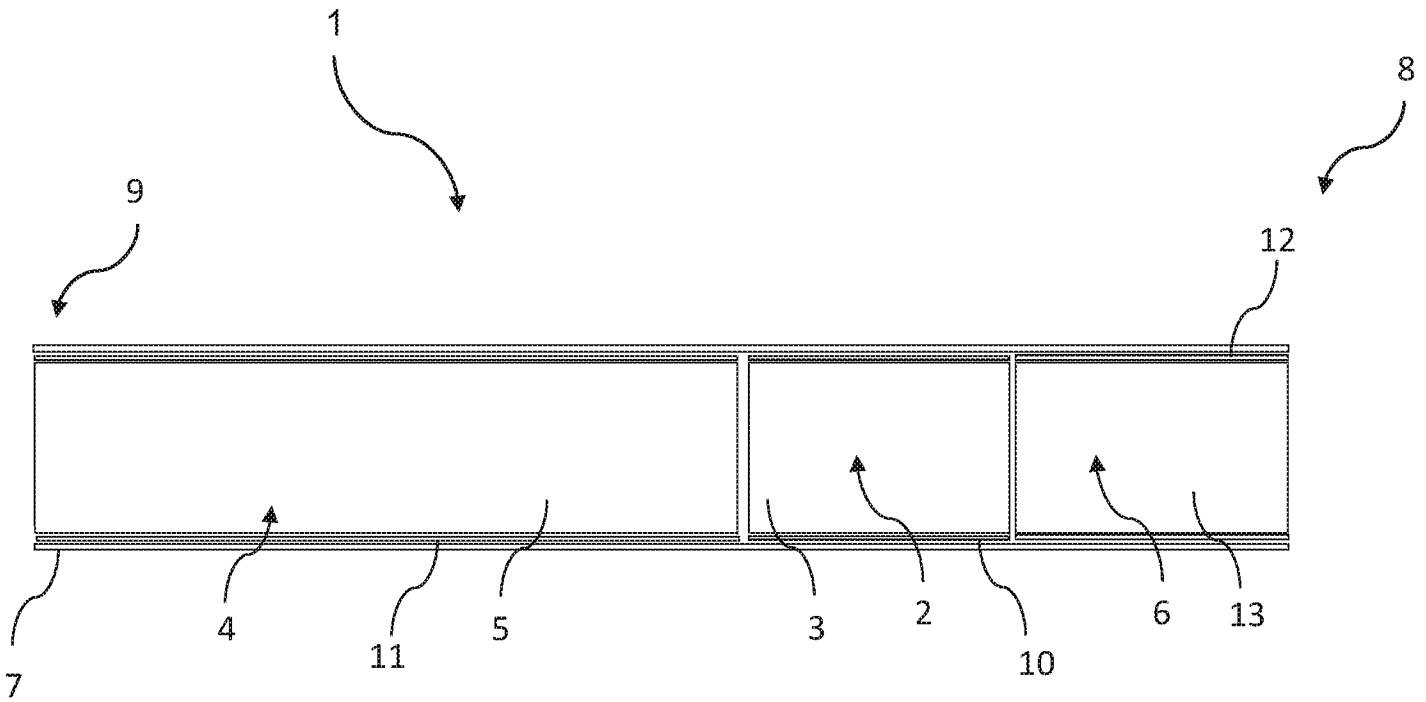
FIG. 1 illustrates an article for use with an aerosol provision device.

As used herein, the term "delivery system" is intended to encompass systems that deliver at least one substance to a user, and includes:

- combustible aerosol provision systems, such as cigarettes, cigarillos, cigars, and tobacco for pipes or for roll-your-own or for make-your-own cigarettes (whether based on tobacco, tobacco derivatives, expanded tobacco, reconstituted tobacco, tobacco substitutes or other smokable material);
- non-combustible aerosol provision systems that release compounds from an aerosol-generating material without combusting the aerosol-generating material, such as electronic cigarettes, tobacco heating products, and hybrid systems to generate aerosol using a combination of aerosol-generating materials; and
- aerosol-free delivery systems that deliver the at least one substance to a user orally, nasally, transdermally or in another way without forming an aerosol, including but not limited to, lozenges, gums, patches, articles comprising inhalable powders, and oral products such as oral tobacco which includes snus or moist snuff, wherein the at least one substance may or may not comprise nicotine.

According to the present disclosure, a "combustible" aerosol provision system is one where a constituent aerosol-generating material of the aerosol provision system (or component thereof) is combusted or burned during use in order to facilitate delivery of at least one substance to a user.

According to the present disclosure, a "non-combustible" aerosol provision system is one where a constituent aerosol-generating material of the aerosol provision system (or component thereof) is not combusted or burned in order to facilitate delivery of at least one substance to a user.

In embodiments described herein, the delivery system is a non-combustible aerosol provision system, such as a powered non-combustible aerosol provision system.

In some embodiments, the non-combustible aerosol provision system is an aerosol-generating material heating system, also known as a heat-not-burn system. An example of such a system is a tobacco heating system.

Typically, the non-combustible aerosol provision system may comprise a non-combustible aerosol provision device and a consumable for use with the non-combustible aerosol provision device.

In some embodiments, the disclosure relates to consumables comprising aerosol-generating material and configured to be used with non-combustible aerosol provision devices. These consumables are sometimes referred to as articles throughout the disclosure.

A consumable is an article comprising or consisting of aerosol-generating material, part or all of which is intended to be consumed during use by a user. A consumable may comprise one or more other components, such as an aerosol-generating material storage area, an aerosol-generating material transfer component, an aerosol generation area, a housing, a wrapper, a mouthpiece, a filter and/or an aerosol-modifying agent. A consumable may also comprise an aerosol generator, such as a heater, that emits heat to cause the aerosol-generating material to generate aerosol in use. The heater may, for example, comprise combustible material, a material heatable by electrical conduction, or a susceptor.

In some embodiments, the non-combustible aerosol provision system, such as a non-combustible aerosol provision device thereof, may comprise a power source and a controller. The power source may, for example, be an electric power source or an exothermic power source. In some embodiments, the exothermic power source comprises a carbon substrate which may be energized so as to distribute power in the form of heat to an aerosol-generating material or to a heat transfer material in proximity to the exothermic power source.

In some embodiments, the non-combustible aerosol provision system may comprise an area for receiving the consumable, an aerosol generator, an aerosol generation area, a housing, a mouthpiece, a filter and/or an aerosol-modifying agent.

In some embodiments, the consumable for use with the non-combustible aerosol provision device may comprise aerosol-generating material, an aerosol-generating material storage area, an aerosol-generating material transfer component, an aerosol generator, an aerosol generation area, a housing, a wrapper, a filter, a mouthpiece, and/or an aerosol-modifying agent.

In some embodiments, the substance to be delivered may be an aerosol-generating material or a material that is not intended to be aerosolized. As appropriate, either material may comprise one or more active constituents, one or more flavors, one or more aerosol-former materials, and/or one or more other functional materials.

An aerosol generator is an apparatus configured to cause aerosol to be generated from the aerosol-generating material. In some embodiments, the aerosol generator is a heater configured to subject the aerosol-generating material to heat energy, so as to release one or more volatiles from the aerosol-generating material to form an aerosol. In some embodiments, the aerosol generator is configured to cause an aerosol to be generated from the aerosol-generating material without heating. For example, the aerosol generator may be configured to subject the aerosol-generating material to one or more of vibration, increased pressure, or electrostatic energy.

Aerosol-generating material is a material that is capable of generating aerosol, for example when heated, irradiated or energized in any other way. Aerosol-generating material may, for example, be in the form of a solid, liquid or gel which may or may not contain an active substance and/or flavorants. In some embodiments, the aerosol-generating material may comprise an "amorphous solid", which may alternatively be referred to as a "monolithic solid" (i.e. non-fibrous). In some embodiments, the amorphous solid may be a dried gel. The amorphous solid is a solid material that may retain some fluid, such as liquid, within it. In some embodiments, the aerosol-generating material may for example comprise from about 50 wt %, 60 wt % or 70 wt % of amorphous solid, to about 90 wt %, 95 wt % or 100 wt % of amorphous solid.

The aerosol-generating material may comprise one or more active substances and/or flavors, one or more aerosol-former materials, and optionally one or more other functional material.

The aerosol-former material may comprise one or more constituents capable of forming an aerosol. In some embodiments, the aerosol-former material may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

The one or more other functional materials may comprise one or more of pH regulators, coloring agents, preservatives, binders, fillers, stabilizers, and/or antioxidants.

The material may be present on or in a support, to form a substrate. The support may, for example, be or comprise paper, card, paperboard, cardboard, reconstituted material, a plastics material, a ceramic material, a composite material, glass, a metal, or a metal alloy. In some embodiments, the support comprises a susceptor. In some embodiments, the susceptor is embedded within the material. In some alternative embodiments, the susceptor is on one or either side of the material.

An aerosol-modifying agent is a substance, typically located downstream of the aerosol generation area, that is configured to modify the aerosol generated, for example by changing the taste, flavor, acidity or another characteristic of the aerosol. The aerosol-modifying agent may be provided in an aerosol-modifying agent release component, that is operable to selectively release the aerosol-modifying agent.

The aerosol-modifying agent may, for example, be an additive or a sorbent. The aerosol-modifying agent may, for example, comprise one or more of a flavorant, a colorant, water, and a carbon adsorbent. The aerosol-modifying agent may, for example, be a solid, a liquid, or a gel. The aerosol-modifying agent may be in powder, thread or granule form. The aerosol-modifying agent may be free from filtration material.

A susceptor is a material that is heatable by penetration with a varying magnetic field, such as an alternating magnetic field. The susceptor may be an electrically-conductive material, so that penetration thereof with a varying magnetic field causes induction heating of the heating material. The heating material may be magnetic material, so that penetration thereof with a varying magnetic field causes magnetic hysteresis heating of the heating material. The susceptor may be both electrically-conductive and magnetic, so that the susceptor is heatable by both heating mechanisms. The device that is configured to generate the varying magnetic field is referred to as a magnetic field generator, herein.

Induction heating is a process in which an electrically-conductive object is heated by penetrating the object with a varying magnetic field. The process is described by Faraday's law of induction and Ohm's law. An induction heater may comprise an electromagnet and a device for passing a varying electrical current, such as an alternating current, through the electromagnet. When the electromagnet and the object to be heated are suitably relatively positioned so that the resultant varying magnetic field produced by the electromagnet penetrates the object, one or more eddy currents are generated inside the object. The object has a resistance to the flow of electrical currents. Therefore, when such eddy currents are generated in the object, their flow against the electrical resistance of the object causes the object to be heated. This process is called Joule, ohmic, or resistive heating. An object that is capable of being inductively heated is known as a susceptor.

In one embodiment, the susceptor is in the form of a closed circuit. It has been found that, when the susceptor is in the form of a closed circuit, magnetic coupling between the susceptor and the electromagnet in use is enhanced, which results in greater or improved Joule heating.

Magnetic hysteresis heating is a process in which an object made of a magnetic material is heated by penetrating the object with a varying magnetic field. A magnetic material can be considered to comprise many atomic-scale magnets, or magnetic dipoles. When a magnetic field penetrates such material, the magnetic dipoles align with the magnetic field. Therefore, when a varying magnetic field, such as an alternating magnetic field, for example as produced by an electromagnet, penetrates the magnetic material, the orientation of the magnetic dipoles changes with the varying applied magnetic field. Such magnetic dipole reorientation causes heat to be generated in the magnetic material.

When an object is both electrically-conductive and magnetic, penetrating the object with a varying magnetic field can cause both Joule heating and magnetic hysteresis heating in the object. Moreover, the use of magnetic material can strengthen the magnetic field, which can intensify the Joule heating.

In each of the above processes, as heat is generated inside the object itself, rather than by an external heat source by heat conduction, a rapid temperature rise in the object and more uniform heat distribution can be achieved, particularly through selection of suitable object material and geometry, and suitable varying magnetic field magnitude and orientation relative to the object. Moreover, as induction heating and magnetic hysteresis heating do not require a physical connection to be provided between the source of the varying magnetic field and the object, design freedom and control over the heating profile may be greater, and cost may be lower.

Articles, for instance those in the shape of rods, are often named according to the product length: "regular" (typically in the range 68-75 mm, e.g. from about 68 mm to about 72 mm), "short" or "mini" (68 mm or less), "king-size" (typically in the range 75-91 mm, e.g. from about 79 mm to about 88 mm), "long" or "super-king" (typically in the range 91-105 mm, e.g. from about 94 mm to about 101 mm) and "ultra-long" (typically in the range from about 110 mm to about 121 mm).

They are also named according to the product circumference: "regular" (about 23-25 mm), "wide" (greater than 25 mm), "slim" (about 22-23 mm), "demi-slim" (about 19-22 mm), "super-slim" (about 16-19 mm), and "micro-slim" (less than about 16 mm).

Accordingly, an article in a king-size, super-slim format will, for example, have a length of about 83 mm and a circumference of about 17 mm.

Each format may be produced with mouthpieces of different lengths. The mouthpiece length will be from about 30 mm to 50 mm. A tipping paper connects the mouthpiece to the aerosol generating material and will usually have a greater length than the mouthpiece, for example from 3 to 10 mm longer, such that the tipping paper covers the mouthpiece and overlaps the aerosol generating material, for instance in the form of a rod of substrate material, to connect the mouthpiece to the rod.

Articles and their aerosol generating materials and mouthpieces described herein can be made in, but are not limited to, any of the above formats.

The terms 'upstream' and 'downstream' used herein are relative terms defined in relation to the direction of mainstream aerosol drawn though an article or device in use.

The filamentary tow material described herein can comprise cellulose acetate fiber tow. The filamentary tow can also be formed using other materials used to form fibers, such as polyvinyl alcohol (PVOH), polylactic acid (PLA), polycaprolactone (PCL), poly(1-4 butanediol succinate) (PBS), poly(butylene adipate-co-terephthalate)(PBAT), starch based materials, cotton, aliphatic polyester materials and polysaccharide polymers or a combination thereof. The filamentary tow may be plasticized with a suitable plasticizer for the tow, such as triacetin where the material is cellulose acetate tow, or the tow may be non-plasticized. The tow can have any suitable specification, such as fibers having a cross section which is 'Y' shaped, 'X' shaped or '0' shaped. The fibers of the tow may have filamentary denier values between 2.5 and 15 denier per filament, for example between 8.0 and 11.0 denier per filament and total denier values of 5,000 to 50,000, for example between 10,000 and 40,000. When viewed in cross section, the fibers may have an isoperimetric ratio $L^2/A$ of 25 or less, such as 20 or less, and for example 15 or less, where L is the length of the perimeter of the cross section and A is the area of the cross section.

As used herein, the term "tobacco material" refers to any material comprising tobacco or derivatives or substitutes thereof. The term "tobacco material" may include one or more of tobacco, tobacco derivatives, expanded tobacco, reconstituted tobacco or tobacco substitutes. The tobacco material may comprise one or more of ground tobacco, tobacco fiber, cut tobacco, extruded tobacco, tobacco stem, tobacco lamina, reconstituted tobacco and/or tobacco extract.

In some embodiments, the substance to be delivered comprises an active substance.

The active substance as used herein may be a physiologically active material, which is a material intended to achieve or enhance a physiological response. The active substance may for example be selected from nutraceuticals, nootropics, psychoactives. The active substance may be naturally occurring or synthetically obtained. The active substance may comprise for example nicotine, caffeine, taurine, thein, vitamins such as B6 or B12 or C, melatonin, cannabinoids, or constituents, derivatives, or combinations thereof. The active substance may comprise one or more constituents, derivatives or extracts of tobacco, *cannabis* or another botanical.

In some embodiments, the active substance comprises nicotine. In some embodiments, the active substance comprises caffeine, melatonin or vitamin B12.

As noted herein, the active substance may comprise or be derived from one or more botanicals or constituents, derivatives or extracts thereof. As used herein, the term "botanical" includes any material derived from plants including, but not limited to, extracts, leaves, bark, fibers, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, *eucalyptus*, star anise, hemp, cocoa, *cannabis*, fennel, lemongrass, peppermint, spearmint, rooibos, chamomile, flax, ginger, *Ginkgo biloba*, hazel, hibiscus, laurel, licorice (liquorice), matcha, mate, orange skin, *papaya*, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, *curcuma*, turmeric, sandalwood, cilantro, bergamot, orange blossom, myrtle, cassis, valerian, pimento, mace, damien, marjoram, olive, lemon balm, lemon basil, chive, *carvi, verbena*, tarragon, geranium, mulberry, *ginseng*, theanine, theacrine, maca, ashwagandha, damiana, guarana, chlorophyll, baobab or any combination thereof. The mint may be chosen from the following mint varieties: *Mentha Arventis, Mentha* c.v., *Mentha* niliaca, *Mentha* piperita, *Mentha piperita citrata* c.v., *Mentha piperita* c.v, *Mentha* spicata crispa, *Mentha cardifolia, Memtha longifolia, Mentha* suaveolens variegata, *Mentha pulegium, Mentha spicata* c.v. and *Mentha suaveolens*

In some embodiments, the active substance comprises or is derived from one or more botanicals or constituents, derivatives or extracts thereof and the botanical is tobacco.

In some embodiments, the active substance comprises or derived from one or more botanicals or constituents, derivatives or extracts thereof and the botanical is selected from *eucalyptus*, star anise, cocoa and hemp.

In some embodiments, the active substance comprises or derived from one or more botanicals or constituents, derivatives or extracts thereof and the botanical is selected from rooibos and fennel.

In some embodiments, the substance to be delivered comprises a flavor.

As used herein, the terms "flavor" and "flavorant" refer to materials which, where local regulations permit, may be used to create a desired taste, aroma or other somatosensorial sensation in a product for adult consumers. They may include naturally occurring flavor materials, botanicals, extracts of botanicals, synthetically obtained materials, or combinations thereof (e.g., tobacco, *cannabis*, licorice (liquorice), *hydrangea*, eugenol, Japanese white bark *magnolia* leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, *papaya*, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, *betel*, shisha, pine, honey essence, rose oil, vanilla, lemon oil, orange oil, orange blossom, cherry blossom, *cassia*, caraway, cognac, jasmine, ylang-ylang, sage, fennel, wasabi, piment, ginger, coriander, coffee, hemp, a mint oil from any species of the genus *Mentha, eucalyptus*, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, *curcuma*, cilantro, myrtle, cassis, valerian, pimento, mace, damien, marjoram, olive, lemon balm, lemon basil, chive, *carvi, verbena*, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some embodiments, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor comprises flavor components extracted from *cannabis*.

In some embodiments, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucolyptol, WS-3.

In the figures described herein, like reference numerals are used to illustrate equivalent features, articles or components.

FIG. 1 shows a rod shaped article 1 for use with a non-combustible aerosol provision device. The article 1 comprises a first rod shaped section 2 comprising a first aerosol generating material 3, the first aerosol generating material 3 comprising tobacco; and a second rod shaped section 4 comprising a second aerosol generating material 5, the second aerosol generating material comprising an aerosol former material.

The first and second sections 2, 4 are combined in alignment with a third (filter) section 6 by a wrapping material 7 which circumscribes the sections 2, 4, 6. Overlapping edges of the wrapping material 7 are provided with adhesive to hold the wrapping material 7 in place. The filter section 6 forms a mouth end 8 of the article 1. The end 9 opposite the mouth end 8 is herein referred to as the distal end 9.

The second section 4 is relatively closer to the distal end 9 than the first section 2. The first section 2 is disposed in between the second section 4 and the filter section 6.

The filter section 6 comprises a plug of filter material 13. The plug may be any suitable filter material, in some embodiments the plug comprises cellulose acetate.

Each section 2, 4, 6 of the article is further provided with an individual wrapping material. The first section 2 is circumscribed by a first section wrapping material 10; the second section 4 is circumscribed by a second section wrapping material 11; and the filter section 6 is circumscribed by a filter section wrapping material 12.

Figure 6:
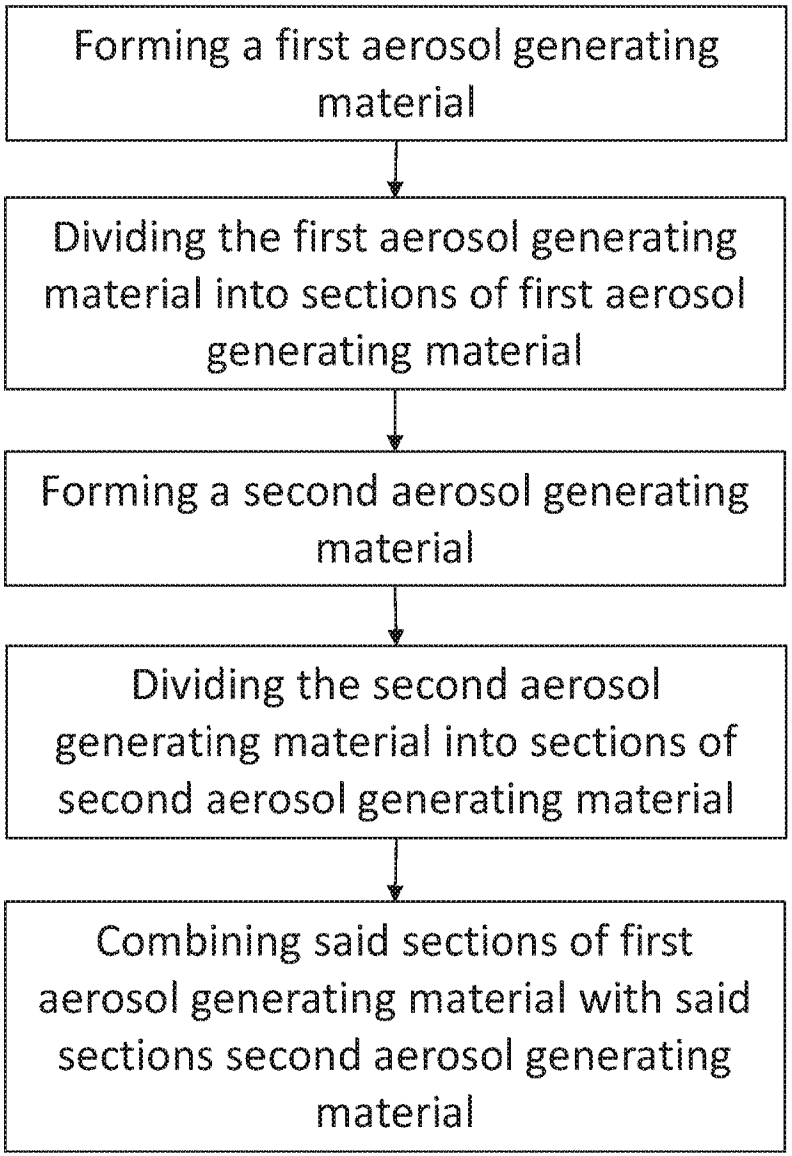
FIG. 6 is a flow chart of a method of manufacturing an article for use with an aerosol provision device.

To assemble the article 1, each section 2, 4, 6 is combined with each of the other two sections in axial alignment and then wrapped by the wrapping material 7. A flow diagram of the assembly process is shown in FIG. 6.

Each section 2, 4, 6 of the article 1 is manufactured using a similar principle, as explained below and shown schematically in FIGS. 2*a* to 2*c*.

Figure 3A:
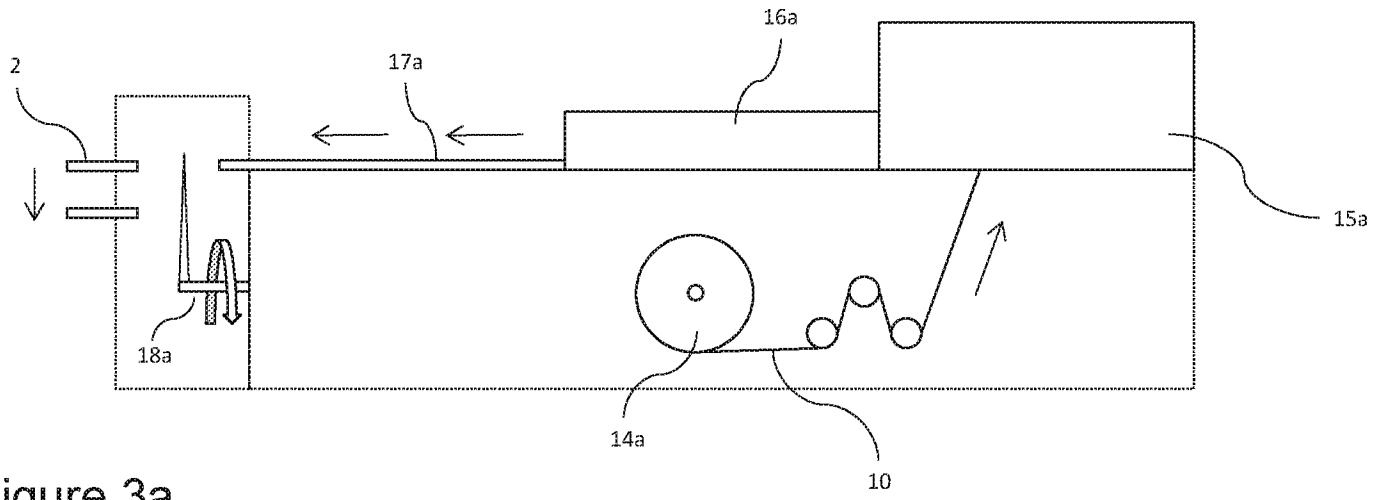
FIG. 3*a* illustrates apparatus for manufacturing a component of an article for use with an aerosol provision device.

Referring to FIG. 3*a*, to manufacture the first section 2, a continuous length of first section wrapping material 10 is drawn from a spool 14*a* and passed sequentially through a filling station 15*a* and a wrapping station 16*a*. In the filling station 15*a* the wrapping material 10 is loaded with the first aerosol generating material 3. The wrapping material and the first aerosol generating material 3 then pass into the wrapping station 16*a*. In the wrapping station 16*a* the continuous length of first section wrapping material 10 is wrapped about its longitudinal axis around the first aerosol generating material 3. Longitudinal edges of the wrapping material 11 partially overlap and are adhered to each other to form a continuous rod of first aerosol generating material 17*a*. The continuous rod 17*a* is then cut into individual first sections 2 by a rotary knife 18*a*.

Figure 3B:
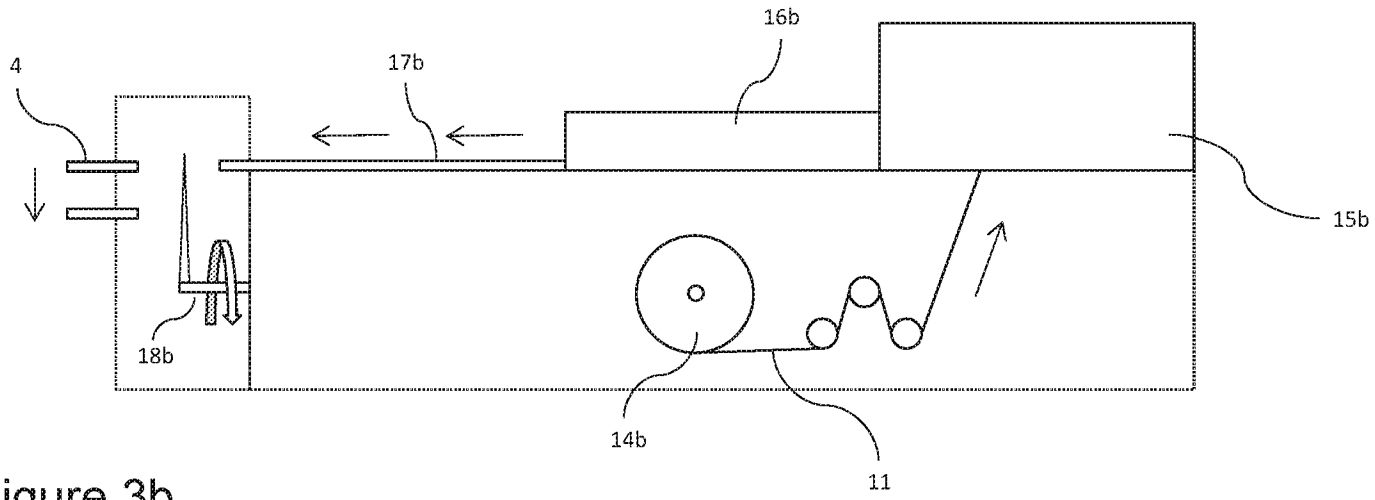
FIG. 3*b* illustrates apparatus for manufacturing a component of an article for use with an aerosol provision device.

Referring to FIG. 3*b*, to manufacture the second section 4: a continuous length of second section wrapping material 11 is drawn from a spool 14*b* and passed sequentially through a filling station 15*b* and a wrapping station 16*b*; where the continuous length of second section wrapping material 11 is filled with the second aerosol generating material 5 and then wrapped—using the same wrapping technique described above in connection with the first section 2 and FIG. 3*a*—to form a continuous rod of second aerosol generating material 17*b*. The continuous rod is then cut into individual second sections 4 by a rotary knife 18*b*.

Figure 3C:
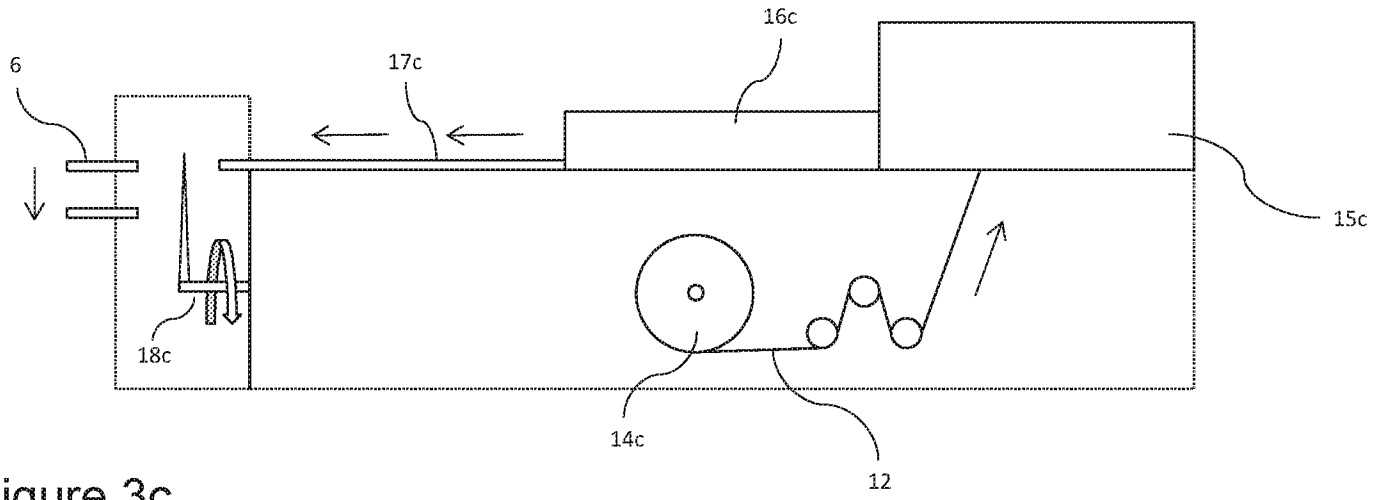
FIG. 3*c* illustrates apparatus for manufacturing a component of an article for use with an aerosol provision device.

Referring to FIG. 3*c*, to manufacture the filter section 6: a continuous length of filter section wrapping material 12 is drawn from a spool 14*c* and passed sequentially through a filling station 15*c* and a wrapping station 16*c*; where the continuous length of filter section wrapping material 12 is filled with filter material 13 and then wrapped—using the same wrapping technique described above in connection with the first and second sections 2, 4—to form a continuous rod of filter material 17*c*. The continuous rod 17*c* is then cut into filter sections 3 by a rotary knife 18*c*.

In each case, the wrapping station 16*a*, 16*b*, 16*c* comprises a garniture (not shown) configured to gradually fold the respective wrapping material 10, 11, 12 into a continuous rod 17*a*, 17*b*, 17*c* as the wrapping material 10, 11, 12 passes therethrough. The garniture comprises a surface that defines a changing profile with passage through the garniture, from a substantially flat surface to a substantially cylindrical one.

In each case, the respective wrapping material 10, 11, 12 may be conveyed using a continuous garniture tape (not shown) on which the wrapping material 10, 11, 12 is supported. The garniture tape passes in a loop around guiding rollers. At least one powered roller is provided to drive the garniture tape around the guiding rollers.

Two methods of assembling the article 1 will be described below.

Figure 4:
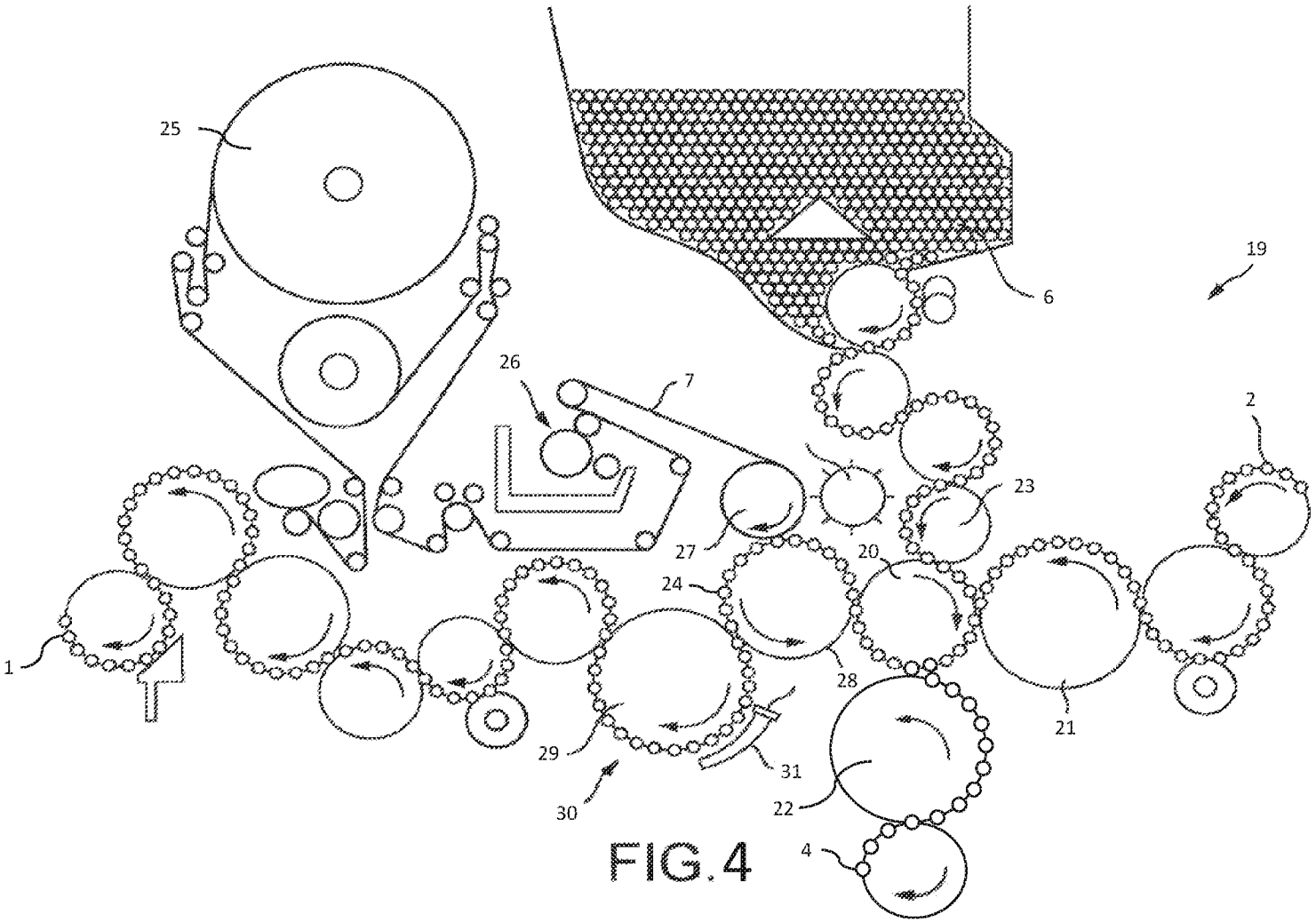
FIG. 4 illustrates apparatus for manufacturing an article for use with an aerosol provision device.

The first method—shown in FIG. 4—comprises cutting a continuous length of wrapping material 7 into an individual wrapping material portion prior to wrapping the individual wrapping material portion around respective sections 2, 4, 6 of the article.

In particular, in accordance with the first method as shown in FIG. 4, each of the individual sections 2, 4, 6 are conveyed by a series of drums 19 to a combining drum 20, whereafter the combined sections are wrapped in individual wrapping material portions as explained below.

Each drum comprises a cylindrical outer surface with a number of channels spaced around the circumference of the outer surface for retaining the rod shaped sections 2, 4, 6 as they are conveyed. Therefore, as the drums rotate, the rod shaped sections 2, 4, 6 are conveyed in a direction transverse to their longitudinal axis. Each drum is closely spaced to an adjacent drum to allow the sections to be directly transferred from one drum to another. The channels may further comprise suction holes to hold the rod shaped sections 2, 4, 6 therein until transfer to an adjacent drum.

First and second section feed drums 21, 22 feed first and second sections 2, 4, respectively, to the combining drum 20. Groups of first and second sections 2, 4 are combined in respective channels with filter sections 6 supplied by a filter section feed drum 23, to form unwrapped groups of sections 2, 4, 6, herein referred to as unwrapped articles 24.

The wrapping material 7 is supplied on a spool. A continuous length of wrapping material is drawn from the spool 25 through an adhesive application station 26 to a cutting station 27. The cutting station 27 cuts the continuous length of wrapping material into individual wrapping material portions.

The combining drum 20 transfers the unwrapped articles 24 to a wrapping material supply drum 28. Individual wrapping material portions are applied to the unwrapped articles 24 at the wrapping material supply drum 28 and adhered to the unwrapped articles 24.

The wrapping material supply drum 28 then transfers the unwrapped articles 24 and the individual wrapping material portions to a rolling drum 29 of a rolling station 30 comprising a roll hand 31. The rolling drum rolls 29 rolls the individual wrapping material portions around the unwrapped articles 24 between the cylindrical outer surface of the rolling drum 29 and the roll hand 31 to form completed articles 1.

Figure 5:
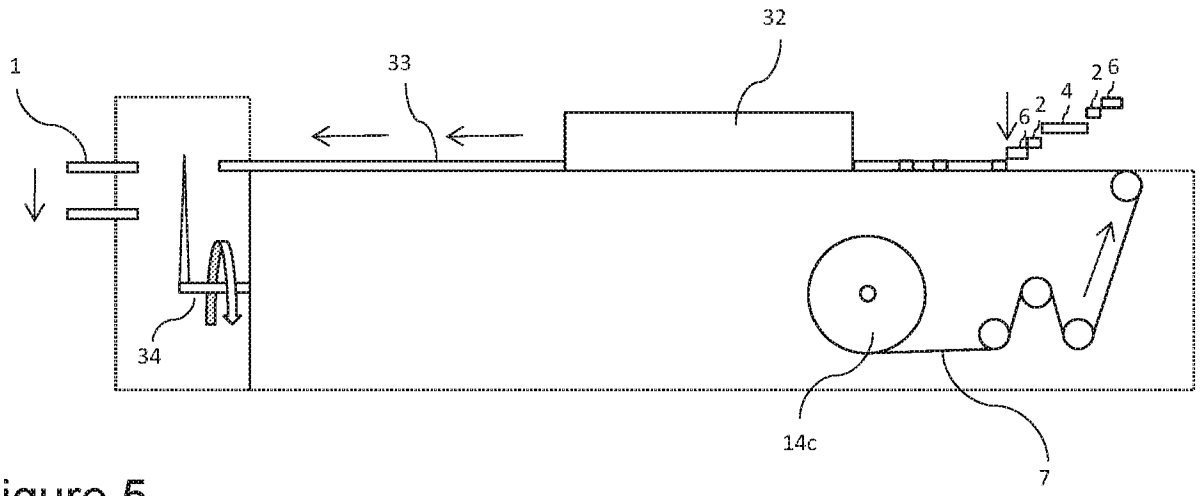
FIG. 5 illustrates apparatus for manufacturing an article for use with an aerosol provision device.

Alternatively, according to the second method as shown in FIG. 5, each of the sections 2, 4, 6 are placed alternately onto a continuous length of wrapping material 7 which is then passed through a wrapping station 32. In the wrapping station 32 the continuous length of wrapping material 7 is wrapped about its longitudinal axis around the sections 2, 4, 6. Longitudinal edges of the wrapping material 7 partially overlap and are adhered to each other to form a continuous rod of alternating sections 33. The continuous rod 33 is then cut into individual articles 1 by a rotary knife 34.

In the illustrated embodiment, the individual sections are placed on the wrapping material in the following order (the numbers denoting the sections according to their reference numbers) 6-2-4-2-6, which is then repeated. Each of the filter sections 6 and each of the second sections 4 are double length. By double length, it is meant twice the length of the respective sections 4, 6 in a finished article. Once wrapped, the rotary knife 34 then repeatedly cuts the continuous rod 33 as it is advanced from the wrapping station 32. The speed of rotation of the rotary knife and the rate of advancement of the continuous rod are kept in register so that the double length sections 4, 6 are cut in half to form back to back finished articles 1.

It shall be appreciated that in some embodiments, the article 1 may comprise an additional section, such as a tubular mouthpiece section. Accordingly, the above methods are not limited to the assembly of articles comprising only three sections 2, 4, 6. The skilled person will readily appreciate that further sections may be provided with limited modification of the described assembly process. For example, in accordance with the first method, a fourth section feed drum may be provided to feed a fourth section to the combining drum 20 so that the combining drum are provided with a first section, second section, filter section and a fourth section. Equally, in accordance with the second method, a fourth section may be placed onto the continuous length of wrapping material along with a corresponding first section, second section and filter section.

In use, the article is inserted into an aerosol provision device which is configured to heat the article so that the aerosol former material of the second aerosol generating material 5 produces an aerosol. When a user draws on the mouth end 8 of the article 1, the aerosol is entrained into an airflow through the article 1 and inhaled by the user.

In some embodiments, the aerosol former material of the second aerosol generating material 5 is a liquid aerosol former material comprising at least one of: glycerine, glycerol or propylene glycol. Therefore, the second aerosol generating material 5 is configured to generate a generally flavorless aerosol, herein referred to as a base aerosol.

In some embodiments, the second aerosol generating material 5 comprises an absorbent material laced with the liquid aerosol former material. The absorbent material may be a fibrous material; for example, natural cotton and/or fibers of viscose. Natural cotton and fibers of viscose are known to withstand the temperature of the heater of the aerosol provision device.

In some embodiments, the second aerosol generating material 5 comprises an absorbent braided material 50, explained further below with reference to FIGS. 12 to 17.

In some embodiments, the aerosol former material of the second aerosol generating material comprises a gel which may or may not contain an active substance and/or flavorants. In some embodiments, the gel may comprise an "amorphous solid", which may alternatively be referred to as a "monolithic solid" (i.e. non-fibrous). In some embodiments, the amorphous solid may be a dried gel. The amorphous solid is a solid material that may retain some fluid, such as liquid, within it. In some embodiments, the gel may for example comprise from about 50 wt %, 60 wt % or 70 wt % of amorphous solid, to about 90 wt %, 95 wt % or 100 wt % of amorphous solid.

In some embodiments, the second aerosol generating material 5 comprises an active substance, such as nicotine.

In some embodiments, the length of the second section 4 is configured to be the same as or slightly greater than the length of a heater within the aerosol provision device. Therefore, the second section 4 only is received within the heater of the aerosol provision device, with the second section 4 being maintained a suitable distance from the heater.

During inhalation, the base aerosol generated by the second aerosol generating material passes through the first section 2. Heat from the aerosol vaporizes volatile elements of the first aerosol generating material 3. The volatile elements of the first aerosol generating material augment the base aerosol with additional flavor and/or active substances, such as nicotine.

To obtain a satisfactory sensory experience, it is important to design the first section 2 to have an appropriate pressure drop. The pressure drop across the first section 2 corresponds to the drop in enthalpy of the base aerosol as it passes through the first section 2. Therefore, the pressure drop across the first section 2 will determine the amount of heat given up by the base aerosol and, therefore, the amount of flavor or active substances that are volatized by the first aerosol generating material 3. There is a balance to be struck. Too high a pressure drop across the first section 2, and the resultant loss of enthalpy will cause excessive condensation of the base aerosol onto the first aerosol generating material 3. Condensation in the first section 2 causes filtration of the volatile elements produced by the first aerosol generating material 3, thus reducing the performance and taste characteristics of the aerosol. However, if the pressure drop is too low, the base aerosol will pass through the first section 2 too quickly and insufficient heat will be given up by the base aerosol to vaporize a satisfactory quantity of volatile elements. Furthermore, if insufficient heat is given up by the base aerosol, the temperature of the aerosol as it passes out of the mouth end 8 may be uncomfortable for a consumer. It is therefore desirable to set the pressure drop that balances these above requirements.

Pressure drop as referred to herein is the 'closed pressure drop', that is to say the pressure drop with any ventilation apertures closed or covered. The pressure drop referred to herein is measured when the article 1 is not in the aerosol provision device. Overall pressure drop, as referred to herein, is the closed pressure drop of the complete article 1.

In some embodiments, the overall pressure drop of the article 1 is between 80 mmWg and 220 mmWg, or between 100 mmWg and 200 mmWg, or between 120 mmWg and 180 mmWg.

In some embodiments, the pressure drop of the first section 2 of the article is between 30 mmWg and 100 mmWg, or between 50 mmWg and 80 mmWg, or between 60 mmWg and 70 mmWg. Therefore, the pressure drop of the first section is able to strike a balance of the conflicting requirements discussed above.

The pressure drop of the first section 2 can be expressed as a percentage of the overall pressure drop. In some embodiments, the pressure drop across the first section 2 is between 30% and 70% of the overall pressure drop, or between 40% and 60% of the overall pressure drop. In some embodiments, the pressure drop of the first section 2 is about 50% of the overall pressure drop. Therefore, the pressure drop of the first section is able to strike a balance of the conflicting requirements discussed above.

In some embodiments, the second section wrapping material 11 comprises a susceptor, such as aluminum foil. Therefore, an induction heater of an aerosol provision device may directly heat the second section wrapping material to produce an aerosol from the second section 4.

The first aerosol generating material comprises tobacco material. The tobacco material may be provided in any suitable form. The tobacco material may comprise conventionally cured tobacco that has been cut or shredded in the normal way. Such tobacco is similar to the tobacco found in cigarettes.

In another embodiment, the tobacco material may be reconstituted to make a tobacco paper which is then shredded or cut into strips. The tobacco paper may be further impregnated with an aerosol former material such as glycerine, glycerol or propylene glycol. Therefore, heat from the aerosol vaporizes the aerosol former material as it passes through the first section 2 during inhalation by a user. Advantageously, the aerosol former material will be flavored by the tobacco paper to provide a tobacco flavor to the aerosol.

In some embodiments, the tobacco paper comprises longitudinal strips of tobacco paper, each longitudinal strip being arranged substantially parallel to a longitudinal axis of the article. Therefore, the resistance to flow of the first section 2 is reduced to allow the base aerosol to pass through without requiring a large effort from the user.

In another embodiment, the tobacco material is reconstituted to make beads of tobacco. The beads of tobacco may have a mean diameter of 0.5 mm to 3 mm. It shall be appreciated that for a given volume occupied by the beads of tobacco, the smaller the mean diameter, the larger the collective surface area presented by the beads of tobacco. Advantageously, the flavor imparted to the aerosol is proportional to the surface area presented by the beads of tobacco.

FIGS. 12 to 17 schematically illustrates a braided absorbent material 50 comprising strands of material 52 braided around the outside of a rod of absorbent material 54 in accordance with principles of the present disclosure.

In some embodiments, the second aerosol generating material 5 of the second section 4 of the article 1 comprises the braided absorbent material 50 as illustrated in FIGS. 12 to 17. For example, where the second aerosol-generating material 5 comprises a liquid aerosol former-material or a gel aerosol-former material, the absorbent material 54 is doused with the aerosol-former material such that the aerosol-former material is contained within the absorbent material 54 when the braided absorbent material 50 forms a part of the article 1. Accordingly, the absorbent material 54 is made from a material which is capable of wicking the aerosol-former material. In other words, the absorbent material 54 uses capillary action to draw the aerosol-former material along the length of the absorbent material 54 so that all of the absorbent material 54 is doused with aerosol-former material. This also allows the aerosol-former material to be applied one end 50*a* of the absorbent material 54 and the aerosol-former material to be drawn through the absorbent material 54 such that there is an even distribution of aerosol-former material within the absorbent material 54. The absorbent material 54 may therefore be made of any material with such wicking properties, for example a fibrous material such as cotton fibers, woollen fibers, silk fibers or other natural fibers, or synthetic fibers such as nylon, polypropylene or polyester fibers.

Although the braided absorbent material 50 illustrated in FIGS. 12 to 17 have a cylindrical cross-section, it will be appreciated that rods of other cross-sections, such as square, hexagonal or octagonal are also possible. The outer diameter and shape of the braided absorbent material 50 may correspond to that of the article 1 such that the braided absorbent material 50 conforms to the outer shape of the article 1. Equally, the braided absorbent material 50 may have a different external geometry to the article 1, but be sized to fit within the general external shape of article 1.

Braided around the outside of the rod of absorbent material 54 are strands of material 52. In other words, strands of material 52 are interweaved around the circumference or perimeter of the rod of absorbent material 54 and along the length of the rod of absorbent material 54 (the x-direction as illustrated in FIGS. 12 to 17).

The strands of material 52 act to strengthen the absorbent material 54 and ensure that the rod of braided absorbent material 50 maintains a rod shape. In other words, the braided strands of material 52 hold the absorbent material 54 in place and prevent the ends of the absorbent material 54 from splaying outwards and losing shape. The strands of material 52 may be a metal wire, such aluminum or a steel wire, such as stainless steel, or may be a similar material to the absorbent material 54, such as cotton thread, woolen thread, thread from a natural fiber or a synthetic thread such as nylon. The thread may have a flavor impregnated into such that the strands of material 52 act as a flavor carrier.

Figure 12:
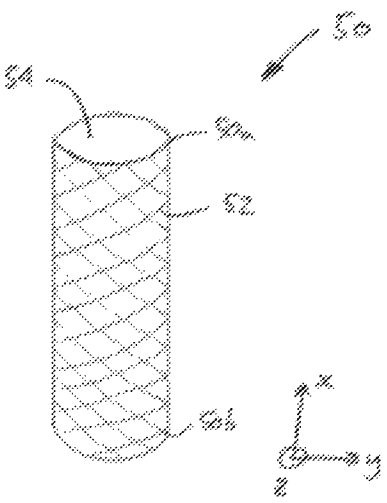
FIG. 12 illustrates a braided absorbent material.
Figure 13:
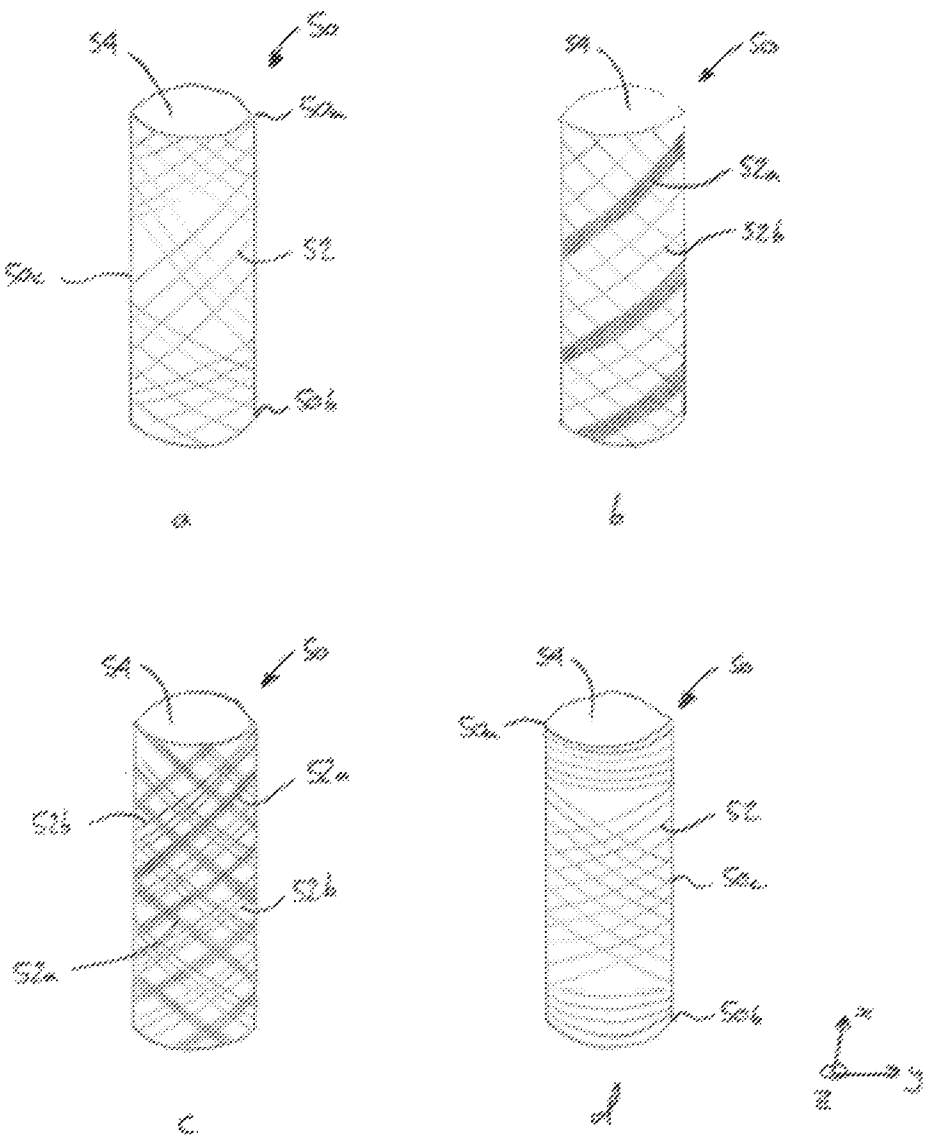
FIG. 13 illustrates a braided absorbent material.

Although the braided strands of material 52 are shown in FIG. 12 as having a uniform or symmetric pattern around the outside of the absorbent material 54, this is not essential, and FIGS. 13*a-d* schematically illustrates alternative braided absorbent materials for the rod of braided material 50.

FIG. 13*a* illustrates a braided absorbent material 50 where the pattern of the braided strands of material 52 is different in the center 50*c* of the rod compared to the ends 50*a*, 50*b* of the rod in the elongate or x-axis direction. In other words, the separation between the strands of material 52 changes from the ends 50*a*, 50*b* of the rod to the middle 50*c* of the rod such that the density of the strands of material 52 covering the absorbent material 54 is different between the ends 50*a*, 50*b* of the rod and the middle 50*c* of the rod of braided absorbent material 50. In the example illustrated in FIG. 13*a*, the separation between the strands of material 52 is greater in the middle 50*c* of the rod compared to the ends 50*a*, 50*b* of the rod, and therefore the density of the strands of material 52 covering the absorbent material 54 is lower in the middle 50*c* of the rod compared to the ends 50*a*, 50*b* of the rod. As the absorbent material 54 has a tendency to separate and splay out at the ends of the rod, having a lower separation between the strands of material 52 (and therefore increasing the density of strands of material 52) at the ends 50*a*, 50*b* of the rod reduces the amount of splaying of the absorbent material 54 that occurs since the absorbent material 54 is held together more tightly by the braided strands of material 52. Alternatively, the separation between the strands of material 52 may be less in the middle 50*c* of the rod compared to the ends 50*a*, 50*b* of the rod.

FIG. 13*d* illustrates an alternative example of a braided absorbent material 50 where the pattern of the braided strands of material 52 is different in the center 50*c* of the rod compared to the ends 50*a*, 50*b* of the rod. In this example, the braided strands of material 52 at the center 50*c* of the rod form a checkered or criss cross pattern, whilst the braided strands of material 52 at the ends 50*a*, 50*b* of the rod are wrapped around the circumference or outside of the absorbent material 54 with little or no interweaving of the strands. As described above, this also provides a tighter wrapping of the strands of material 52 around the absorbent material 54 at the ends 50*a*, 50*b* of the rod to prevent splaying or separation of the absorbent material 54.

In some examples, strands of material 52 are be knotted together at locations around the outside of the absorbent material 54 in order to fixed the strands of material 52 in place and provide more support to the absorbent material 54. For example, the strands of material 52 can be knotted at the ends of the rod of braided absorbent material 50 in order to prevent the absorbent material 54 from splaying outwards and to prevent the strands of material 52 from unravelling or otherwise moving away from their desired location.

Alternatively or in addition, the strands of material 52 can be fixed into position by heating the rod of braided absorbent material 50 so that the strands of material 52 melt and fuse or otherwise bond together. For example, one or more of the strands of material 52 can be a material with a sufficiently low melting point that heat can be applied to the rod of braided absorbent material 50 in order to melt the material without melting or otherwise damaging any of the other components of the rod of braided absorbent material 50.

FIGS. 13*b* and 13*c* illustrate a braided absorbent material 50 where the strands of material comprise a first material and a second material, and the first material is different from the second material. The first material 52*a* is illustrated in FIGS. 13*b* and 13*c* by the thick lines around the outside of the absorbent material 54, and the second material 52*b* is illustrated in FIGS. 13*b* and 13*c* by the thin lines around the outside of the absorbent material 54. It will be appreciated that this is simply for ease of illustration, and the respective diameters or widths of the first material and the second material may be substantially the same, or the diameters or width of the second material may be greater than the diameters or width of the first material.

The first material 52*a* may be a metal wire, such aluminum or a steel wire, such as stainless steel. When the braided absorbent material 50 forms a part of an article 1 for use with a non-combustible aerosol provision device, the conductive properties of the metal wire can be used as a susceptor material as described above.

The second material 52*b* may also be a metal wire, but a different type of metal wire compared to the first material 52*a*. For example, the second material 52*b* may be a magnetic metal wire whilst the first material is stainless steel wire. Alternatively, the second material 52*b* may be a similar material to the absorbent material 54, such as cotton thread, nylon thread or woolen thread. As described above, the thread may have a flavor impregnated into it such that the second material acts as a flavor carrier whilst the first material acts as a susceptor.

As illustrated in FIGS. 13*b* and 13*c*, the first material 52*a* may be braided around the outside of the rod of absorbent material 54 in a first pattern, and the second material 52*b* is be braided around the rod of absorbent material 54 in a second pattern.

In FIG. 13*b* the first pattern and the second pattern are different. The first pattern is a helical or coil shape whilst the second pattern is forms a checkered or criss cross pattern. Having the first pattern different to the second pattern allows the distribution of the first material 52*a* and second material 52*b* around the outside of the rod of absorbent material 54 to be optimized based on the respective functions of the first material and the second material. For example, where the first material 52*a* is a stainless steel wire and the second material 52*b* is cotton thread, the first material 52*a* may act as a susceptor material, and the pattern of the first material 52*a* can be chosen to provide a consistent distribution of heating along the rod of absorbent material 54. The second material 52*b* (cotton thread) may act as structural enforcement for the rod of absorbent material 54, and therefore the pattern of the second material 52*b* may be chosen to provide additional support at the ends of the rod compared to the center of the rod in order to prevent the absorbent material 54 from splaying out at the ends of the rod, as described above with reference to FIGS. 13*a* and 13*b*.

FIG. 13*c* illustrates an alternative example of patterns of the first material 52*a* and the second material 52*b*. In this example, the first pattern and the second pattern both result in a checkered or criss cross pattern of the first material 52*a* and the second material 52*b*, but the spacing between the strands of the first material 52*a* and the second material 52*b* are different. In other words, both the first pattern and the second pattern result in a braid of the first material 52*a* and the second material 52*b*, respectively, but the overall density and spacing between the strands of the first material 52*a* and the strands of the second material 52*b* is different. As illustrated in FIG. 13*c*, there are three strands of the second material 52*b* between each strand of the first material 52*a*, such that the density of the second material 52*b* around the outside of the absorbent material 54 is greater than the density of the first material 52*a* around the outside of the absorbent material 54. In other words, the spacing between each strand of the first material is greater than the spacing between each strand of second material 52*b* around the outside of the absorbent material. Alternatively, the first pattern and the second pattern may be different such that the density of the second material 52*b* around the outside of the absorbent material 54 is less than the density of the first material 52*a* around the outside of the absorbent material 54, and therefore the spacing between each strands of the second material 52*b* is greater than the spacing between each strands of the first material 52*a* around the outside of the absorbent material 54.

Figure 14:
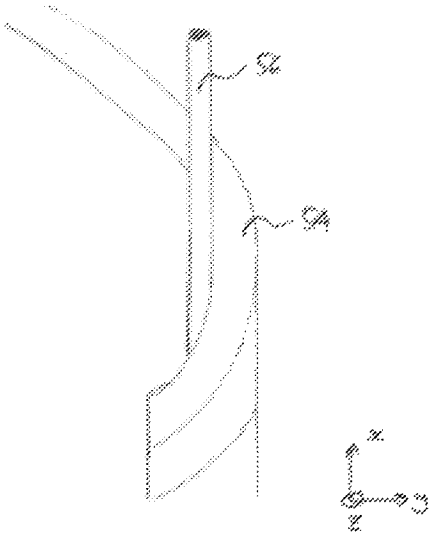
FIG. 14 illustrates a braided absorbent material.

FIG. 14 schematically illustrates a rod of absorbent material 54 formed by wrapping the absorbent material 54 around a continuous core of material 56 in accordance with principles of the present disclosure. The continuous core of material 56 could be formed of a metallic wire in order to act as a susceptor material as described above. This may be in addition to or in the place of a susceptor in the strands of material 52 braided around the outside of the rod of absorbent material 54. The continuous core of material 56 may be formed of a metallic wire or plastics material to act as a structural support for the absorbent material 54 such that the rod of absorbent material 54 maintains its shape. In some applications, the continuous core of material 56 may be a hollow tube, for example made of a plastics or metallic material, thereby providing an additional air path through the rod of absorbent material 54 when the rod of braided absorbent material 50 forms part of the article 1 for use with a non-combustible aerosol provision device. It will be appreciated that the continuous core of material 56 may provide multiple functions, for example a hollow metallic tube to act as a susceptor material and provide an additional air path.

Figure 15:
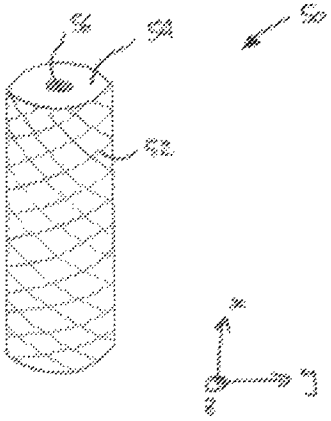
FIG. 15 illustrates a braided absorbent material.

FIG. 15 schematically illustrates a rod of braided absorbent material 50 including the rod of absorbent material 54 illustrated in FIG. 14 in accordance with principles of the present disclosure. As illustrated in FIG. 15, the strands of material 52 are braided around the outside of the rod of absorbent material 54, which includes the continuous core of material 56, as described above with reference to FIGS. 12 and 13.

Figure 16:
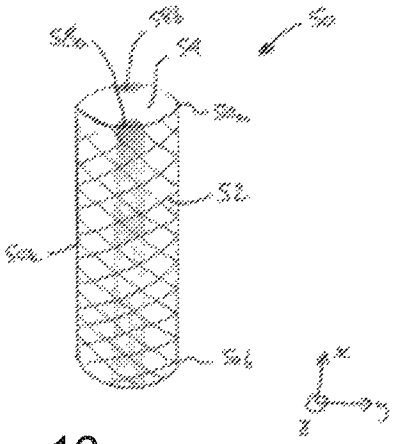
FIG. 16 illustrates a braided absorbent material.

FIG. 16 schematically illustrates a rod of braided absorbent material 50 in accordance with principles of the present disclosure, where one or more additional materials 58*a*, 58*b* are laid on the outside of the rod of absorbent material 54 before the strands of material 52 are braided around the outside of the rod of absorbent material 54. In other words, the additional material 58 lies between the rod of absorbent material 54 and the branded strands of material 52. The additional materials 58 may include a metallic wire, for example to act as a susceptor, and/or a metallic or plastics material to provide structural reinforcement to the rod of absorbent material 54. The additional materials 58 may include one or more threads, such as cotton or wool, which are impregnated with flavoring such that the additional material 58 acts as a flavor carrier. The additional materials 58 may include a hollow plastics or metallic tube, where the hollow portion of the tube provides an air path through the rod of braided absorbent material 50 when the rod of braided absorbent material 50 forms part of a consumable 10 for a non-combustible aerosol provision system 20. When there are two or more additional materials 58*a*, 58*b*, each material may be the same or it may be different. For example, the first additional material 58*a* may be a metal wire whilst the second additional material 58*b* may be a thread impregnated with a flavorant.

Although the additional materials 58*a*, 58*b* are illustrated in FIG. 16 as extending along the entire length of the rod of braided absorbent material 50 in the x-direction, this is not essential. In other examples the additional material 58 may be located in the middle 50*c* of the rod of braided absorbent material 50 in the elongate or x-direction such that the additional material does not extend fully to the ends 50*a*, 50*b* of the rod. Alternatively, the additional material 58 may be located at one or more ends 50*a*, 50*b* of the rod and not present in the middle 50*c* of the rod. Equally the additional material 58 may not be axially aligned with the rod of braided absorbent material 50. In other words, the additional material 58 may not extend straight along the elongate or x-axis of the rod of braided absorbent material 50. For example, the additional material 58 may be helically wound around the rod of absorbent material 54 or wrapped partially or fully around the circumference or perimeter of the rod of absorbent material 54 perpendicular to the elongate or x-axis of the rod. In the case where the additional material 58 is helically wound around the rod of absorbent material 54, the helix or coil of additional material 58 may follow a similar path around the outside of the rod of absorbent material 54 as one or more of the strands of material 52 that are braided around the outside of the rod of absorbent material 54.

Figure 17:
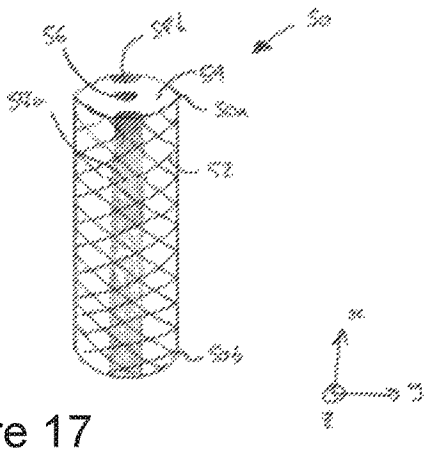
FIG. 17 illustrates a braided absorbent material.

FIG. 17 schematically illustrates a rod of braided absorbent material 50 which includes both a continuous core of material 56 as described above in relation to FIG. 15 and one or more additional materials 58*a*, 58*b* laid on the outside of the rod of absorbent material 54 as described above in relation to FIG. 16. Accordingly, the features described above in relation to these figures may be used in combination. It will also be appreciated that any of the features of the braided strands of material 52 and the absorbent material 54, in particular those described above with reference to FIGS. 12 and 13, may also be used in combination with the examples illustrated in FIGS. 14 to 17.

Although two additional materials 58*a*, 58*b* are shown in FIGS. 16 and 17, it will be appreciated that any number of additional materials, such as one, five or 10, may be laid around the outside of the rod of absorbent material 54. Further, although the additional materials 58*a*, 58*b* are shown in FIGS. 16 and 17 to be evenly distributed around the circumference or perimeter of the rod of absorbent material 54, this is not essential. For example, where there are two additional materials 58*a*, 58*b*, these may be located proximate to each other around the circumference or perimeter of the rod of absorbent material 54 rather than diametrically opposite each other.

Any of the rods of braided absorbent material 50 described above with reference to FIGS. 12 to 17 may form part of the article 1 as described above with reference to FIGS. 1 to 6, where the reference frames in each figure are the same.

In the present example, the article 1 has an outer circumference of about 21 mm (i.e. the article is in the demi-slim format). In some examples, the article 1 has a second section 4 having a circumference greater than 19 mm. This has been found to provide a sufficient circumference to generate an improved and sustained aerosol over a usual aerosol generation session preferred by consumers. As the article is heated, heat transfers through the aerosol generating material 5 of the second section 4 to volatize components of the aerosol generating material 5, and circumferences greater than 19 mm have been found to be particularly effective at producing an aerosol in this way. Since the article is to be heated to release an aerosol, improved heating efficiency can be achieved using articles having circumferences of less than about 23 mm. To achieve improved aerosol via heating, while maintaining a suitable product length, circumferences of greater than 19 mm and less than 23 mm can be advantageous. In some examples, the circumference can be between 20 mm and 22 mm, which has been found to provide a good balance between providing effective aerosol delivery while allowing for efficient heating.

The outer circumference of the filter section 6 is substantially the same as the outer circumference of the first and second sections 2, 4, such that there is a smooth transition between these components. In the present example, the outer circumference of the filter section 6 is about 20.8 mm.

The wrapping material 7 can have a basis weight which is higher than the basis weight of the other wrapping materials 10, 11, 12 used in the article 1, for instance a basis weight of 40 gsm to 80 gsm, such as between 50 gsm and 70 gsm, and in the present example 58 gsm. These ranges of basis weights have been found to result in wrapping materials having acceptable tensile strength while being flexible enough to wrap around the article 1 and adhere to itself along overlapping longitudinal edges of the paper 7.

In some examples, the wrapping material 7 comprises citrate, such as sodium citrate or potassium citrate. In such examples, the wrapping material 7 may have a citrate content of 2% by weight or less, or 1% by weight or less. Reducing the citrate content of the wrapping material 7 is thought to assist with reducing the charring effect which may occur during use.

In some embodiments, the respective wrapping materials 10, 11, 12 of the first section 2, second section 4 and filter section 6 have a basis weight of less than 50 gsm, such as between about 20 gsm and 40 gsm. In some examples, said wrapping materials 10, 11, 12 have a thickness of between 30 μm and 60 μm, such as between 35 μm and 45 μm. In some examples, said wrapping materials 10, 11, 12 are a non-porous plug wrap, for instance having a permeability of less than 100 Coresta units, for instance less than 50 Coresta units. However, in other embodiments, said wrapping materials 10, 11, 12 can be a porous plug wrap, for instance having a permeability of greater than 200 Coresta Units. In some examples, the length of the filter section 6 is less than about 20 mm. In the present example, the length of the filter section 6 is 16 mm.

In the present example, the filter section 6 comprises a body formed from filamentary tow. In the present example, the tow used in the body has a denier per filament (d.p.f.) of 8.4 and a total denier of 21,000. Alternatively, the tow can, for instance, have a denier per filament (d.p.f.) of 9.5 and a total denier of 12,000. In the present example, the tow comprises plasticized cellulose acetate tow. The plasticizer used in the tow comprises about 7% by weight of the tow. In the present example, the plasticizer is triacetin. In other examples, different materials can be used to form the body. For instance, rather than tow, the body of the filter section 6 can be formed from paper, for instance in a similar way to paper filters known for use in cigarettes. Alternatively, the body can be formed from tows other than cellulose acetate, for instance polylactic acid (PLA), other materials described herein for filamentary tow or similar materials. The tow can be formed from cellulose acetate. The tow, whether formed from cellulose acetate or other materials, can have a d.p.f. of at least 5, such as at least 6 and for example at least 7. These values of denier per filament provide a tow which has relatively coarse, thick fibers with a lower surface area which result in a lower pressure drop across the filter section 6 than tows having lower d.p.f. values. In some examples, to achieve a sufficiently uniform body, the tow has a denier per filament of no more than 12 d.p.f., such as no more than 11 d.p.f. and for example no more than 10 d.p.f.

The total denier of the tow forming the body of the filter section 6 can be at most 30,000, such as at most 28,000 and for example at most 25,000. These values of total denier provide a tow which takes up a reduced proportion of the cross sectional area of the filter section 6 which results in a lower pressure drop across the filter section 6 than tows having higher total denier values. For appropriate firmness of the filter section 6, the tow can have a total denier of at least 8,000 and for example at least 10,000. In some examples, the denier per filament is between 5 and 12 while the total denier is between 10,000 and 25,000. For example, the denier per filament is between 6 and 10 while the total denier is between 11,000 and 22,000. In some examples the cross-sectional shape of the filaments of tow are 'Y' shaped, although in other embodiments other shapes such as 'X' shaped filaments can be used, with the same d.p.f. and total denier values as provided herein.

The cross section of the filaments of tow may have an isoperimetric ratio L2/A of 25 or less, 20 or less, or 15 or less, where L is the length of the perimeter of the cross section and A is the area of the cross section. Such filaments of tow have a relatively low surface area for a given value of denier per filament, which improves delivery of aerosol to the consumer. In some examples, the body may comprise an adsorbent material (e.g. charcoal) dispersed within the tow.

In some examples, the body of the filter section 6 may comprise a capsule. The capsule can comprise a breakable capsule, for instance a capsule which has a solid, frangible shell surrounding a liquid payload. In some examples, a single capsule is used. The capsule is entirely embedded within the body of the filter section 6. In other words, the capsule is completely surrounded by the material forming the body. In other examples, a plurality of breakable capsules may be disposed within the body of the filter section 6, for instance 2, 3 or more breakable capsules. The length of the body of the filter section 6 can be increased to accommodate the number of capsules required. In examples where a plurality of capsules is used, the individual capsules may be the same as each other, or may differ from one another in terms of size and/or capsule payload. In other examples, multiple bodies of material may be provided, with each body containing one or more capsules.

The capsule has a core-shell structure. In other words, the capsule comprises a shell encapsulating a liquid agent, for instance a flavorant or other agent, which can be any one of the flavorants or aerosol modifying agents described herein. The shell of the capsule can be ruptured by a user to release the flavorant or other agent into the body of the filter section 6. The filter section wrapping material 12 can comprise a barrier coating to make the material 12 of the filter section 6 substantially impermeable to the liquid payload of the capsule. Alternatively or in addition, the wrapping material 7 can comprise a barrier coating to make the wrapping material 7 substantially impermeable to the liquid payload of the capsule.

In some examples, the capsule is spherical and has a diameter of about 3 mm. In other examples, other shapes and sizes of capsule can be used. The total weight of the capsule may be in the range about 10 mg to about 50 mg.

It is known to generate, for a given tow specification (such as 8.4Y21000), a tow capability curve which represents the pressure drop through a length of rod formed using the tow, for each of a range of tow weights. Parameters such as the rod length and circumference, wrapper thickness and tow plasticizer level are specified, and these are combined with the tow specification to generate the tow capability curve, which gives an indication of the pressure drop which would be provided by different tow weights between the minimum and maximum weights achievable using standard filter rod forming machinery. Such tow capability curves can be calculated, for instance, using software available from tow suppliers. It has been found that it is particularly advantageous to use a body for a filter section 6 which includes filamentary tow having a weight per mm of length of the body which is between about 10% and about 30% of the range between the minimum and maximum weights of a tow capability curve generated for the filamentary tow. This can provide an acceptable balance between providing enough tow weight to avoid shrinkage after the body has been formed, providing an acceptable pressure drop, while also assisting with capsule placement within the tow, for capsules of the sizes described herein.

Figure 2:
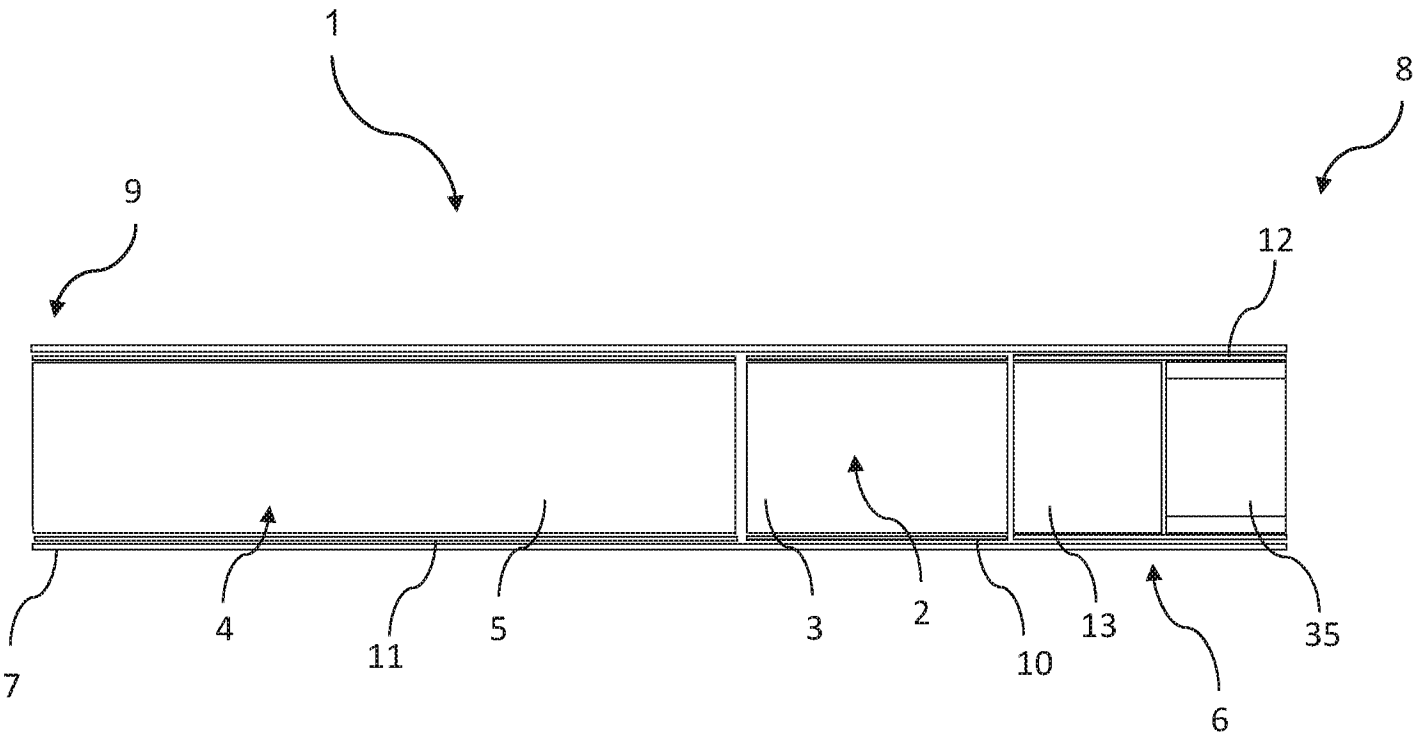
FIG. 2 illustrates an article for use with an aerosol provision device.

In some embodiments, the filter section 6 may further comprise a hollow tubular element 35—as shown in FIG. 2. The hollow tubular element 4 may advantageously have a length of greater than about 10 mm, for instance between about 10 mm and about 30 mm or between about 12 mm and about 25 mm. It has been found that a consumer's lips are likely to extend in some cases to about 12 mm from the mouth end 8 of the article 1 when drawing aerosol through the article 1, and therefore a hollow tubular element 4 having a length of at least 10 mm or at least 12 mm means that most of the consumer's lips surround this element 4.

Figure 7:
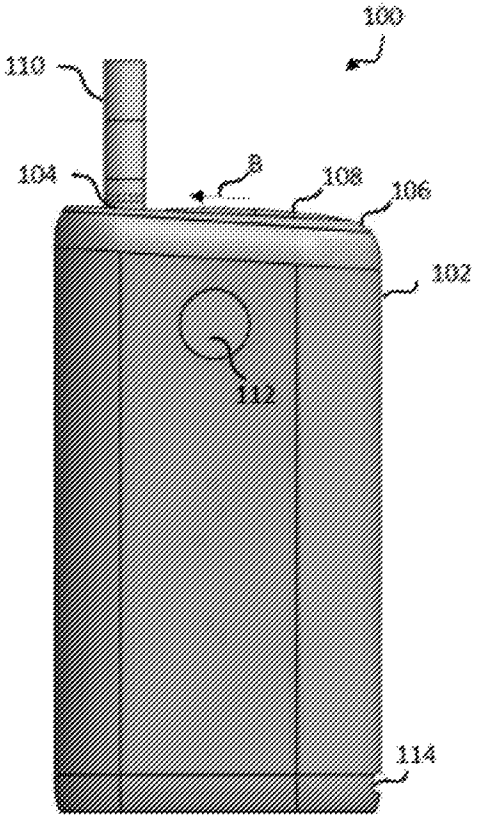
FIG. 7 illustrates an aerosol provision device.

FIG. 7 shows an example of a non-combustible aerosol provision device 100 for generating aerosol from an aerosol generating medium/material such as the aerosol generating materials 3, 5 of the articles 1 described herein. In broad outline, the device 100 may be used to heat a replaceable article 1 comprising the aerosol generating medium, for instance the article 1 described herein, to generate an aerosol or other inhalable medium which is inhaled by a user of the device 100. The device 100 and replaceable article 1 together form a system.

The device 100 comprises a housing 102 (in the form of an outer cover) which surrounds and houses various components of the device 100. The device 100 has an opening 104 in one end, through which the article 1 may be inserted for heating by a heating assembly. In use, the article 1 may be fully or partially inserted into the heating assembly where it may be heated by one or more components of the heater assembly.

The device 100 of this example comprises a first end member 106 which comprises a lid 108 which is moveable relative to the first end member 106 to close the opening 104 when no article 1 is in place. In FIG. 7, the lid 108 is shown in an open configuration, however the lid 108 may move into a closed configuration. For example, a user may cause the lid 108 to slide in the direction of arrow "B".

The device 100 may also include a user-operable control element 112, such as a button or switch, which operates the device 100 when pressed. For example, a user may turn on the device 100 by operating the switch 112.

The device 100 may also comprise an electrical component, such as a socket/port 114, which can receive a cable to charge a battery of the device 100. For example, the socket 114 may be a charging port, such as a USB charging port.

Figure 8:
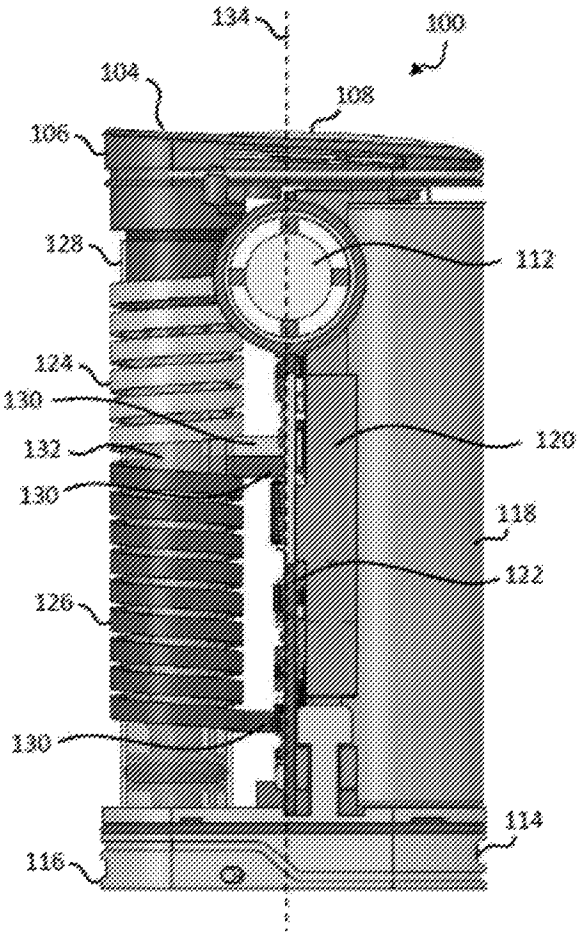
FIG. 8 illustrates part of an aerosol provision device.

FIG. 8 depicts the device 100 of FIG. 7 with the outer cover 102 removed and without an article 1 present. The device 100 defines a longitudinal axis 134.

As shown in FIG. 8, the first end member 106 is arranged at one end of the device 100 and a second end member 116 is arranged at an opposite end of the device 100. The first and second end members 106, 116 together at least partially define end surfaces of the device 100. For example, the bottom surface of the second end member 116 at least partially defines a bottom surface of the device 100. Edges of the outer cover 102 may also define a portion of the end surfaces. In this example, the lid 108 also defines a portion of a top surface of the device 100.

The end of the device closest to the opening 104 may be known as the proximal end (or mouth end) of the device 100 because, in use, it is closest to the mouth of the user. In use, a user inserts an article 1 into the opening 104, operates the user control 112 to begin heating the aerosol generating material and draws on the aerosol generated in the device. This causes the aerosol to flow through the device 100 along a flow path towards the proximal end of the device 100.

The other end of the device furthest away from the opening 104 may be known as the distal end of the device 100 because, in use, it is the end furthest away from the mouth of the user. As a user draws on the aerosol generated in the device, the aerosol flows away from the distal end of the device 100.

The device 100 further comprises a power source 118. The power source 118 may be, for example, a battery, such as a rechargeable battery or a non-rechargeable battery. Examples of suitable batteries include, for example, a lithium battery (such as a lithium-ion battery), a nickel battery (such as a nickel—cadmium battery), and an alkaline battery. The battery is electrically coupled to the heating assembly to supply electrical power when required and under control of a controller (not shown) to heat the aerosol generating material. In this example, the battery is connected to a central support 120 which holds the battery 118 in place.

The device further comprises at least one electronics module 122. The electronics module 122 may comprise, for example, a printed circuit board (PCB). The PCB 122 may support at least one controller, such as a processor, and memory. The PCB 122 may also comprise one or more electrical tracks to electrically connect together various electronic components of the device 100. For example, the battery terminals may be electrically connected to the PCB 122 so that power can be distributed throughout the device 100. The socket 114 may also be electrically coupled to the battery via the electrical tracks.

In the example device 100, the heating assembly is an inductive heating assembly and comprises various components to heat the aerosol generating material of the article 1 via an inductive heating process. Induction heating is a process of heating an electrically conducting object (such as a susceptor) by electromagnetic induction. An induction heating assembly may comprise an inductive element, for example, one or more inductor coils, and a device for passing a varying electric current, such as an alternating electric current, through the inductive element. The varying electric current in the inductive element produces a varying magnetic field. The varying magnetic field penetrates a susceptor suitably positioned with respect to the inductive element, and generates eddy currents inside the susceptor. The susceptor has electrical resistance to the eddy currents, and hence the flow of the eddy currents against this resistance causes the susceptor to be heated by Joule heating. In cases where the susceptor comprises ferromagnetic material such as iron, nickel or cobalt, heat may also be generated by magnetic hysteresis losses in the susceptor, i.e. by the varying orientation of magnetic dipoles in the magnetic material as a result of their alignment with the varying magnetic field. In inductive heating, as compared to heating by conduction for example, heat is generated inside the susceptor, allowing for rapid heating. Further, there need not be any physical contact between the inductive heater and the susceptor, allowing for enhanced freedom in construction and application.

The induction heating assembly of the example device 100 comprises a susceptor arrangement 132 (herein referred to as "a susceptor"), a first inductor coil 124 and a second inductor coil 126. The first and second inductor coils 124, 126 are made from an electrically conducting material. In this example, the first and second inductor coils 124, 126 are made from Litz wire/cable which is wound in a helical fashion to provide helical inductor coils 124, 126. Litz wire comprises a plurality of individual wires which are individually insulated and are twisted together to form a single wire. Litz wires are designed to reduce the skin effect losses in a conductor. In the example device 100, the first and second inductor coils 124, 126 are made from copper Litz wire which has a rectangular cross section. In other examples the Litz wire can have other shape cross sections, such as circular.

The first inductor coil 124 is configured to generate a first varying magnetic field for heating a first section of the susceptor 132 and the second inductor coil 126 is configured to generate a second varying magnetic field for heating a second section of the susceptor 132. In this example, the first inductor coil 124 is adjacent to the second inductor coil 126 in a direction along the longitudinal axis 134 of the device 100 (that is, the first and second inductor coils 124, 126 to not overlap). The susceptor arrangement 132 may comprise a single susceptor, or two or more separate susceptors. Ends 130 of the first and second inductor coils 124, 126 can be connected to the PCB 122.

It will be appreciated that the first and second inductor coils 124, 126, in some examples, may have at least one characteristic different from each other. For example, the first inductor coil 124 may have at least one characteristic different from the second inductor coil 126. More specifically, in one example, the first inductor coil 124 may have a different value of inductance than the second inductor coil 126. In FIG. 8, the first and second inductor coils 124, 126 are of different lengths such that the first inductor coil 124 is wound over a smaller section of the susceptor 132 than the second inductor coil 126. Thus, the first inductor coil 124 may comprise a different number of turns than the second inductor coil 126 (assuming that the spacing between individual turns is substantially the same). In yet another example, the first inductor coil 124 may be made from a different material to the second inductor coil 126. In some examples, the first and second inductor coils 124, 126 may be substantially identical.

In this example, the first inductor coil 124 and the second inductor coil 126 are wound in opposite directions. This can be useful when the inductor coils are active at different times. For example, initially, the first inductor coil 124 may be operating to heat a first section/portion of the article 1, and at a later time, the second inductor coil 126 may be operating to heat a second section/portion of the article 1. Winding the coils in opposite directions helps reduce the current induced in the inactive coil when used in conjunction with a particular type of control circuit. In FIG. 8, the first inductor coil 124 is a right-hand helix and the second inductor coil 126 is a left-hand helix. However, in another embodiment, the inductor coils 124, 126 may be wound in the same direction, or the first inductor coil 124 may be a left-hand helix and the second inductor coil 126 may be a right-hand helix.

The susceptor 132 of this example is hollow and therefore defines a receptacle within which aerosol generating material is received. For example, the article 1 can be inserted into the susceptor 132. In this example the susceptor 120 is tubular, with a circular cross section.

The susceptor 132 may be made from one or more materials. In some examples the susceptor 132 comprises carbon steel having a coating of Nickel or Cobalt.

In some examples, the susceptor 132 may comprise at least two materials capable of being heated at two different frequencies for selective aerosolization of the at least two materials. For example, a first section of the susceptor 132 (which is heated by the first inductor coil 124) may comprise a first material, and a second section of the susceptor 132 which is heated by the second inductor coil 126 may comprise a second, different material. In another example, the first section may comprise first and second materials, where the first and second materials can be heated differently based upon operation of the first inductor coil 124. The first and second materials may be adjacent along an axis defined by the susceptor 132, or may form different layers within the susceptor 132. Similarly, the second section may comprise third and fourth materials, where the third and fourth materials can be heated differently based upon operation of the second inductor coil 126. The third and fourth materials may be adjacent along an axis defined by the susceptor 132, or may form different layers within the susceptor 132. Third material may the same as the first material, and the fourth material may be the same as the second material, for example. Alternatively, each of the materials may be different. The susceptor may comprise carbon steel or aluminum for example.

The device 100 of FIG. 8 further comprises an insulating member 128 which may be generally tubular and at least partially surround the susceptor 132. The insulating member 128 may be constructed from any insulating material, such as plastic for example. In this particular example, the insulating member is constructed from polyether ether ketone (PEEK). The insulating member 128 may help insulate the various components of the device 100 from the heat generated in the susceptor 132.

The insulating member 128 can also fully or partially support the first and second inductor coils 124, 126. For example, as shown in FIG. 8, the first and second inductor coils 124, 126 are positioned around the insulating member 128 and are in contact with a radially outward surface of the insulating member 128. In some examples the insulating member 128 does not abut the first and second inductor coils 124, 126. For example, a small gap may be present between the outer surface of the insulating member 128 and the inner surface of the first and second inductor coils 124, 126.

In a specific example, the susceptor 132, the insulating member 128, and the first and second inductor coils 124, 126 are coaxial around a central longitudinal axis of the susceptor 132.

Figure 9:
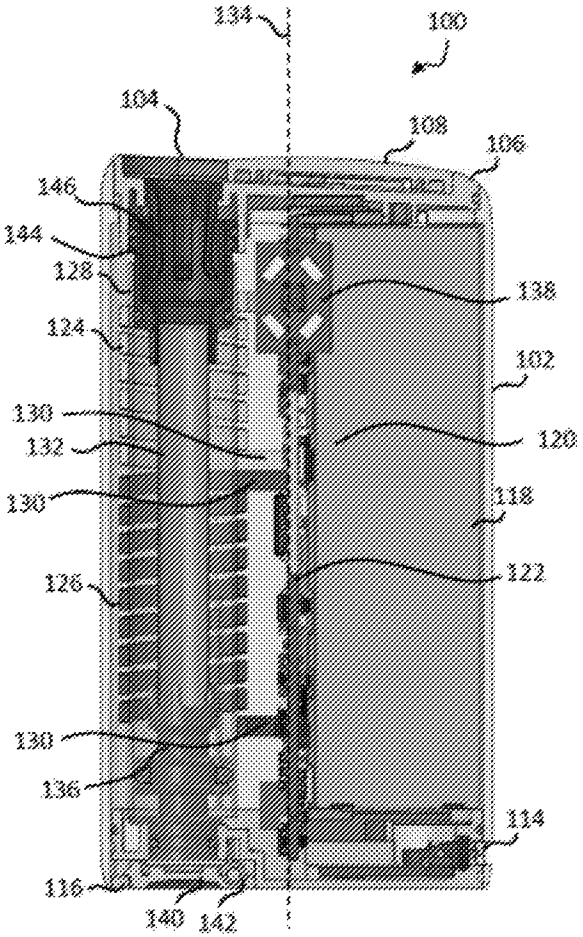
FIG. 9 illustrates part of an aerosol provision device.

FIG. 9 shows a side view of device 100 in partial cross-section. The outer cover 102 is present in this example. The rectangular cross-sectional shape of the first and second inductor coils 124, 126 is more clearly visible.

The device 100 further comprises a support 136 which engages one end of the susceptor 132 to hold the susceptor 132 in place. The support 136 is connected to the second end member 116.

The device may also comprise a second printed circuit board 138 associated within the control element 112.

The device 100 further comprises a second lid/cap 140 and a spring 142, arranged towards the distal end of the device 100. The spring 142 allows the second lid 140 to be opened, to provide access to the susceptor 132. A user may open the second lid 140 to clean the susceptor 132 and/or the support 136.

The device 100 further comprises an expansion chamber 144 which extends away from a proximal end of the susceptor 132 towards the opening 104 of the device. Located at least partially within the expansion chamber 144 is a retention clip 146 to abut and hold the article 1 when received within the device 100. The expansion chamber 144 is connected to the end member 106.

Figure 10:
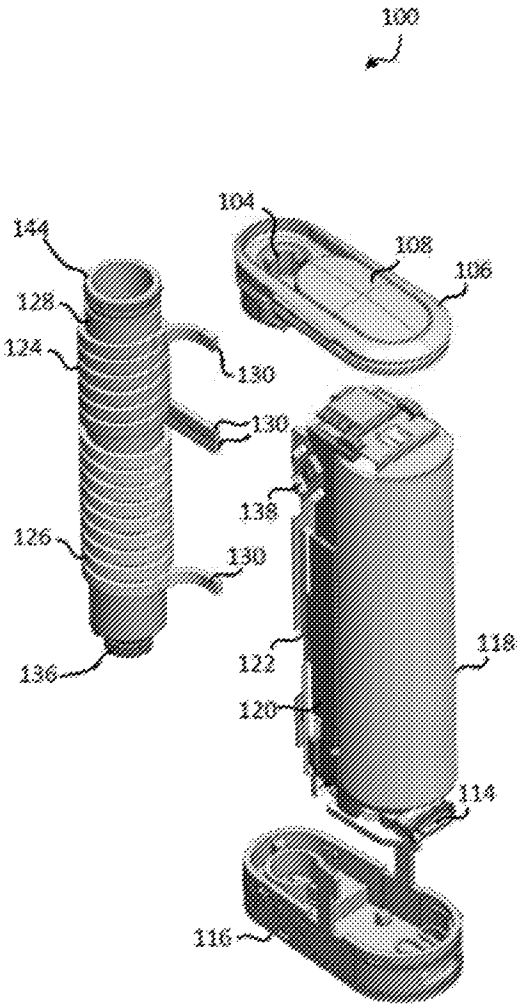
FIG. 10 illustrates part of an aerosol provision device.

FIG. 10 is an exploded view of the device 100 of FIG. 9, with the outer cover 102 omitted.

Figures 11A, 11B:
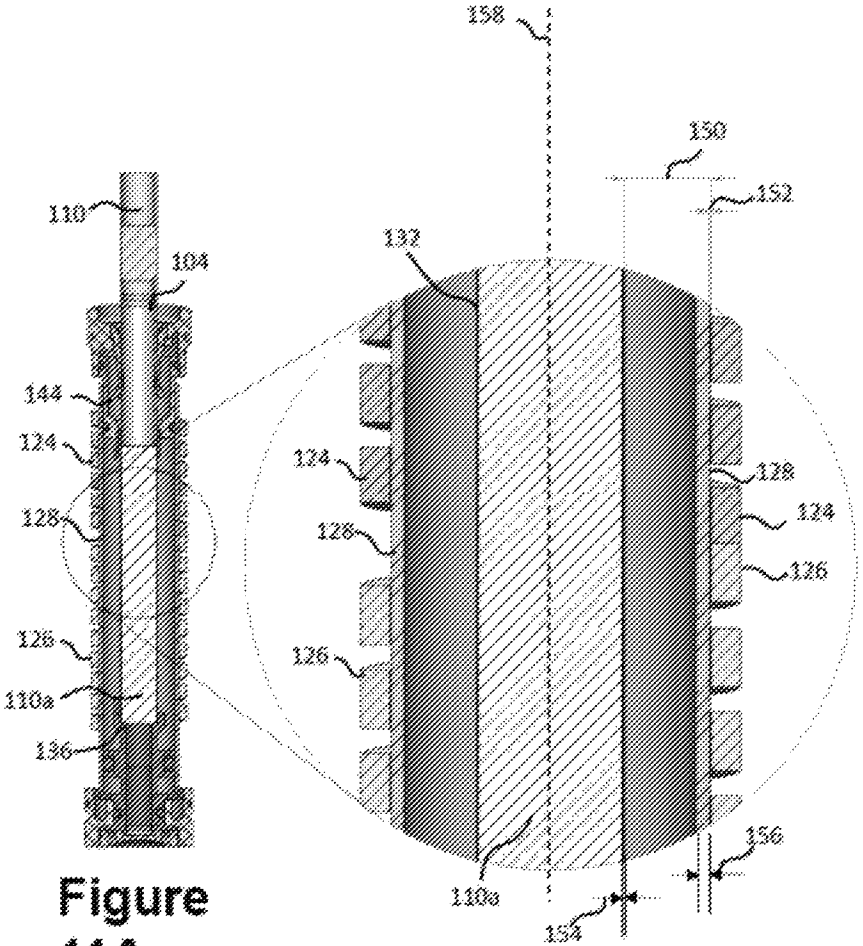
FIG. 11A illustrates part of an aerosol provision device.
FIG. 11B is a detail view of part of an aerosol provision device.

FIG. 11A depicts a cross section of a portion of the device 100 of FIG. 9. FIG. 11B depicts a close-up of a region of FIG. 11A. FIGS. 11A and 11B show the article 1 received within the susceptor 132, where the article 1 is dimensioned so that the outer surface of the article 1 abuts the inner surface of the susceptor 132. This ensures that the heating is most efficient. The article 1 of this example comprises aerosol generating material 110*a*. The aerosol generating material 110*a*—for example the second aerosol generating material 5 of the articles 1 described above—is positioned within the susceptor 132. The article 1 may also comprise other components such as a filter, wrapping materials and/or a cooling structure.

FIG. 11B shows that the outer surface of the susceptor 132 is spaced apart from the inner surface of the inductor coils 124, 126 by a distance 150, measured in a direction perpendicular to a longitudinal axis 158 of the susceptor 132. In one particular example, the distance 150 is about 3 mm to 4 mm, about 3-3.5 mm, or about 3.25 mm.

FIG. 11B further shows that the outer surface of the insulating member 128 is spaced apart from the inner surface of the inductor coils 124, 126 by a distance 152, measured in a direction perpendicular to a longitudinal axis 158 of the susceptor 132. In one particular example, the distance 152 is about 0.05 mm. In another example, the distance 152 is substantially 0 mm, such that the inductor coils 124, 126 abut and touch the insulating member 128.

In one example, the susceptor 132 has a wall thickness 154 of about 0.025 mm to 1 mm, or about 0.05 mm.

In one example, the susceptor 132 has a length of about 40 mm to 60 mm, about 40 mm to 45 mm, or about 44.5 mm.

In one example, the insulating member 128 has a wall thickness 156 of about 0.25 mm to 2 mm, 0.25 mm to 1 mm, or about 0.5 mm. In use, the article 1 described herein can be inserted into a non-combustible aerosol provision device such as the device 100 described with reference to FIGS. 7 to 11. At least a portion of the article 1 protrudes from the non-combustible aerosol provision device 100 and can be placed into a user's mouth. An aerosol is produced by heating the aerosol generating material 3, 5 using the device 100. The aerosol produced by the aerosol generating material 3, 5 passes through the article 1 to the user's mouth.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the disclosure as defined by the claims or limitations on equivalents to the claims, and that other embodiments may be utilized and modifications may be made without departing from the scope of the claims. Various embodiments of the disclosure may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. An article for use with a non-combustible aerosol provision device having a mouth end and a distal end opposite the mouth end, the article comprising:

a first section comprising a first aerosol generating material, the first aerosol generating material comprising tobacco; and a second section comprising a second aerosol generating material, the second aerosol generating material comprising an aerosol former material;

wherein the second section is relatively closer to the distal end than the first section;

wherein a pressure drop across the first section is between 30% and 70% of a pressure drop across the complete article.

2. The article according to claim 1, wherein the aerosol former material comprises at least one of: glycerine, glycerol or propylene glycol.

3. The article according to claim 1, wherein the second section comprises an absorbent material laced with the aerosol generating material.

4. The article according to claim 3, wherein the absorbent material is a fibrous material.

5. The article according to claim 4, wherein the fibrous material comprises at least one of:

natural cotton; or of viscose.

6. The article according to claim 1, wherein the second aerosol generating material comprises a gel.

7. The article according to claim 1, wherein the second aerosol generating material comprises nicotine.

8. The article according to claim 1, wherein the second section comprises a rod of braided absorbent material.

9. The article according to claim 8, wherein the rod of braided absorbent material comprises strands of material braided around an outside of the rod of absorbent material.

10. The article according to claim 9, wherein the absorbent material is doused with the aerosol former material.

11. The article according to claim 9, wherein the absorbent material is cotton.

12. The article according to claim 9, wherein at least one of the strands of material is a susceptor.

13. The article according to claim 12, wherein the susceptor is metal wire.

14. The article according to claim 8, further comprising a susceptor wrapped around the rod of braided absorbent material.

15. The article of claim 14, wherein the susceptor is an aluminum coated material.

16. The article according to claim 1, wherein the tobacco material comprises tobacco granules.

17. The article according to claim 16, wherein the tobacco granules comprise cut tobacco.

18. The article according to claim 16, wherein the tobacco granules comprise beads of tobacco.

19. The article according to claim 1, wherein the tobacco material comprises a tobacco paper.

20. The article according to claim 19, wherein the tobacco paper comprises longitudinal strips of tobacco paper, each longitudinal strip being arranged substantially parallel to a longitudinal axis of the article.

21. The article according to claim 1, wherein the first aerosol generating material comprises an aerosol-former material.

22. The articled according to claim 21, wherein the aerosol former material comprises at least one of: glycerine, glycerol or propylene glycol.

23. The article according to claim 1, wherein the article is a rod shaped article.

24. The article according to claim 23, wherein the article further comprises a filter section forming the mouth end of the article.

25. The article according to claim 24, wherein the filter section comprises a tubular body.

26. The article according to claim 24, wherein the filter section comprises a capsule.

27. The Previously Presented article according to claim 1, wherein the first section and the second section are combined by at least one wrapping material.

28. The article according to claim 27, wherein the at least one wrapping material comprises a susceptor.

29. The article according to claim 28, wherein the susceptor comprises aluminum foil.

30. A system comprising:

the non-combustible aerosol provision device comprising a heater; and the article according to claim 1.

31. A method of manufacturing an article according to claim 1 for use with a non-combustible aerosol provision device, the method comprising: forming a first aerosol generating material; dividing the first aerosol generating material into sections of first aerosol generating material; forming a second aerosol generating material; dividing the second aerosol generating material into sections of second aerosol generating material; and combining the sections of first aerosol generating material with the sections second aerosol generating material.

* * * * *